US011186000B2

(12) United States Patent
Lap et al.

(10) Patent No.: US 11,186,000 B2
(45) Date of Patent: Nov. 30, 2021

(54) SHAVING UNIT AND SHAVING APPARATUS WITH SUPPORTING STRUCTURE FOR EXTERNAL CUTTING MEMBER

(71) Applicant: KONINKLIJKE PHILIPS N.V., Eindhoven (NL)

(72) Inventors: Reinder Niels Lap, Surhuizum (NL); Alwin William De Vries, Zuidlaren (NL); Marcus Cornelis Petrelli, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 16/479,958

(22) PCT Filed: Jan. 23, 2018

(86) PCT No.: PCT/EP2018/051499
§ 371 (c)(1),
(2) Date: Jul. 23, 2019

(87) PCT Pub. No.: WO2018/138063
PCT Pub. Date: Aug. 2, 2018

(65) Prior Publication Data

US 2020/0189133 A1 Jun. 18, 2020

(30) Foreign Application Priority Data

Jan. 27, 2017 (EP) ..... 17153528

(51) Int. Cl.
*B26B 19/14* (2006.01)
*B26B 19/38* (2006.01)

(52) U.S. Cl.
CPC ..... *B26B 19/145* (2013.01); *B26B 19/3846* (2013.01); *B26B 19/146* (2013.01)

(58) Field of Classification Search
CPC ..... B26B 19/14–18
(Continued)

(56) References Cited

U.S. PATENT DOCUMENTS 3,715,803 A 2/1973 Tyler
5,131,148 A 7/1992 Wahl
(Continued)

FOREIGN PATENT DOCUMENTS

CN 101683739 3/2010
WO 2008/010139 1/2008
WO 2011/055323 5/2011

OTHER PUBLICATIONS

International Search Report and Written Opinion dated Apr. 26, 2018 For International Application No. PCT/EP2018/051499 Filed Jan. 23, 2018.

*Primary Examiner* — Jason Daniel Prone

(57) ABSTRACT

A shaving unit for a shaving apparatus has at least two cutting units each including an external cutting member having hair entry openings and an internal cutting member which is rotatable relative to the external cutting member about an axis of rotation. Each cutting unit has a housing accommodating a hair collection chamber. A cover portion of the housing is releasably coupled to a base portion. The external and internal cutting members are held in an operating position in the cover portion by a holding component which is releasably coupled to the cover portion. The base portion of the housing of each cutting unit has a supporting structure where, in the closed position of the housing, the external cutting member is directly supported by the supporting structure at least in an axial direction parallel to the axis of rotation.

17 Claims, 11 Drawing Sheets

(58) Field of Classification Search
USPC ..... 43/4–6; 30/43.4–43.6
See application file for complete search history.

(56) References Cited

U.S. PATENT DOCUMENTS

| | | | | |
|---|---|---|---|---|
| 5,625,950 | A * | 5/1997 | Sterk | B26B 19/145 30/346.51 |
| 6,886,255 | B2 * | 5/2005 | Freas | B26B 19/06 30/200 |
| 8,296,954 | B2 * | 10/2012 | Schneider | B26B 19/14 30/43.4 |
| 8,393,082 | B2 * | 3/2013 | Shimizu | B26B 19/146 30/43.6 |
| 9,009,978 | B2 * | 4/2015 | Schneider | B26B 19/14 30/43.4 |
| 9,126,345 | B2 * | 9/2015 | Darwinkel | B26B 19/14 |
| 9,713,876 | B2 * | 7/2017 | Brada | B26B 19/143 |
| RE47,515 | E * | 7/2019 | Westerhof | B26B 19/145 |
| 10,654,182 | B2 * | 5/2020 | Meijer | B26B 19/14 |
| 10,933,545 | B2 * | 3/2021 | Lap | B26B 19/146 |
| 2008/0276459 | A1 | 11/2008 | De Wit | |
| 2010/0018058 | A1 * | 1/2010 | Brada | B26B 19/38 30/43.6 |
| 2013/0019480 | A1 | 1/2013 | Schneider | |
| 2014/0196292 | A1 | 7/2014 | Schmitt | |
| 2019/0337171 | A1 * | 11/2019 | Lap | B26B 19/146 |
| 2019/0389084 | A1 * | 12/2019 | Lap | B26B 19/145 |

* cited by examiner

SHAVING UNIT AND SHAVING APPARATUS WITH SUPPORTING STRUCTURE FOR EXTERNAL CUTTING MEMBER

CROSS REFERENCE TO RELATED APPLICATIONS

This application is the U.S. National Phase application under 35 U.S.C. § 371 of International Application No. PCT/EP2018/051499 filed Jan. 23, 2018, published as WO 2018/138063 on Aug. 2, 2018, which claims the benefit of European Patent Application Number 17153528.9 filed Jan. 27, 2017. These applications are hereby incorporated by reference herein.

FIELD OF THE INVENTION

The invention relates to a shaving unit for a shaving apparatus, the shaving unit comprising at least two cutting units. Further, the invention relates to a shaving apparatus comprising such a shaving unit.

BACKGROUND OF THE INVENTION

Shaving units and apparatus as described beforehand may comprise two or more cutting units. Each cutting unit effects cutting of hairs by a movement of an internal cutting member relative to an external cutting member which is brought into contact with the skin of the user and guided across the skin during the shaving procedure. During such shaving procedure a certain pressure is exerted by the user on the shaving unit to press the external cutting member against the skin to support the hairs present on the skin to enter the cutting units via the hair entry openings provided in the external cutting members in order to be cut.

One aspect related to a convenient and comfortable shaving procedure is a good contour-following property of the cutting units across the skin, whereby pressure peaks between the cutting units and the skin are avoided or at least reduced to a certain extent. Generally, for this purpose the external cutting member is surrounded by a skin contact element, which is also known as a floe, and which provides an additional skin contact surface sideways of the external cutting member to achieve a better distribution of the contact pressure and a better alignment and gliding of the external cutting member relative to the skin. Further, in many known shaving units the external cutting member and/or the floe are pivotal relative to the housing of the cutting unit, such that by a pivoting movement a better contour-following property of the cutting unit is achieved and pressure peaks on prominent skin regions are avoided or reduced. The pivotal movement of the external cutting member and the floe may be a joint pivotal movement of the external cutting member and the floe about a joint pivot axis or about a joint primary pivot axis and a joint secondary pivot axis.

WO 2011/055323 discloses a shaving unit comprising three cutting units. Each cutting unit comprises a housing comprising a base portion and a cover portion which is coupled to the base portion via a hinge structure. In each cutting unit, the cover portion carries an external cutting member, interacting with a rotatable internal cutting member, and has an annular skin contact element surrounding the external cutting member. The external cutting member and the internal cutting member are held in an operating position in the cover portion by means of a holding component. Thus, the entire cover portion, comprising the annular skin contact element and the holding component and carrying the external cutting member and the internal cutting member, is pivotally coupled to the base portion of the housing. By pivoting the cover portion relative to the base portion, a hair collection chamber accommodated in the housing becomes accessible for the user, e.g. for cleaning. Furthermore, the holding component is releasably coupled to the cover portion by means of a further hinge structure. By releasing the holding component from the cover portion and pivoting the holding component relative to the cover portion, the internal cutting member and the external cutting member are released and thus can be removed from the cover portion, e.g. for being cleaned or for being exchanged by new cutting members.

In this known shaving unit, external pressure forces exerted on the external cutting member during shaving are mainly transferred to the holding component which holds the internal cutting member and the external cutting member in their operating positions in the cover portion. Via the holding component, these external pressure forces are transferred to the cover portion and further to the base portion of the housing, which supports the cover portion in the closed operational position of the cover portion. As a consequence, the holding component should have a sufficiently rigid structure in order to be able to support and hold the external cutting member in a stable position relative to the cover portion during use. In addition, since the holding component needs to be releasably coupled to the cover portion, the holding component has a coupling structure by means of which the releasable coupling of the holding component to the cover portion is established. Because a part of said external pressure forces is transferred from the holding component to the cover portion via said coupling structure, also the coupling structure needs to be sufficiently rigid in order to prevent an unintentional release of the holding component from the cover portion under the influence of the external pressure forces during use. The rigid structures of the holding component and the coupling structure lead to an additional volume of the cutting unit. Furthermore, as a result of the rigid structure of the coupling structure, the user needs to exert a relatively high force on the coupling structure in order to release the holding component from the cover portion. As a result, the structural set-up of this known shaving unit may be difficult to handle for a user, and demounting and mounting of all components of the cutting units of the shaving unit may be a difficult task.

SUMMARY OF THE INVENTION

It is an object of the invention to provide a shaving unit and a shaving apparatus having such a shaving unit with an improved external load carrying function such that the mounting and demounting of the components of the cutting units is simplified.

In order to achieve this object, a shaving unit according to the invention comprises at least two cutting units, wherein each cutting unit comprises an external cutting member having a plurality of hair entry openings, an internal cutting member which is rotatable relative to the external cutting member about an axis of rotation, and a housing accommodating a hair collection chamber, the housing comprising a base portion and a cover portion which is releasably coupled to the base portion, wherein the external cutting member and the internal cutting member are held in an operating position in the cover portion by means of a holding component which is releasably coupled to the cover portion, wherein said housing has a closed condition, wherein the cover portion holding the external cutting member and the internal cutting member is coupled to the base portion and closes the hair collection chamber, and an opened condition, wherein the cover portion is at least partially released and at least partially removed from the base portion so that the hair collection chamber is accessible for a user, wherein the base portion of the housing of each cutting unit comprises a supporting structure, and wherein in the closed position of the housing the external cutting member is supported by the supporting structure at least in an axial direction parallel to the axis of rotation.

A shaving unit according to the invention comprises at least two cutting units, and may in particular comprise three, four, five or even more than five cutting units. Each cutting unit comprises an external cutting member, which may be part of a cap-shaped structure and wherein a plurality of hair entry openings is provided. These hair entry openings may define a shaving track, which is preferably a circular shaving track. The hair entry openings may be provided as a plurality of openings, like circular bores or slit-shaped openings, arranged in an annular surface region of the external cutting member.

The external cutting member has cutting edges provided at the hair entry openings, which interact with cutting edges provided on the internal cutting member which is rotatable relative to the external cutting member. By the rotation of the internal cutting member relative to the external cutting member, a shearing force is imparted by the cooperating cutting edges of the internal and the external cutting members on the hairs which reach through the hair entry openings, and this shearing or cutting force effects the shaving action.

Furthermore, each cutting unit comprises a housing which accommodates a hair collection chamber wherein the cut hairs are received and collected. For this purpose, the hair collection chamber is arranged in such a position in relation to the internal cutting member and the external cutting member that hairs which are cut by the interaction of the two cutting members are received by the hair collection chamber. In order to make the hair collection chamber accessible for a user, e.g. to remove the collected cut hairs and other shaving debris from the hair collecting chamber, the housing comprises a base portion and a cover portion which is releasably coupled to the base portion. The cover portion accommodates the external cutting member and the internal cutting member, wherein the external cutting member may e.g. be arranged in an opening provided in an upper wall of the cover portion. In the closed condition of the housing, the cover portion is coupled to the base portion, so that the hair collection chamber is closed. In the opened condition of the housing, the cover portion is at least partially released and at least partially removed from the base portion, so that the hair collection chamber is accessible for the user for cleaning. The cover portion and the base portion may comprise any suitable coupling structure for the releasable coupling of the cover portion to the base portion. By decoupling of the coupling structure, the cover portion may be fully removed, i.e. fully separated from the base portion. Alternatively, the coupling structure may only allow a partial removal of the cover portion from the base portion such that the hair collection chamber becomes accessible for the user, e.g. by having a hinge mechanism by means of which the cover portion is pivotally connected to the base portion.

Furthermore, according to the invention each cutting unit comprises a holding component which serves to hold the external cutting member and the internal cutting member in an operating position in the cover portion during use. The holding component is releasably coupled to the cover portion. In particular in the opened condition of the housing, the holding component can be released from the cover portion, so that the user can remove the internal cutting member and/or the external cutting member from the cover portion, e.g. to separately clean these cutting members or to replace them by new cutting members. The cover portion and the holding component may comprise any suitable coupling structure for the releasable coupling of the holding component to the cover portion. By decoupling of this coupling structure, the holding component may be fully removed, i.e. fully separated from the cover portion. Alternatively, the coupling structure may only allow a partial removal of the holding component from the cover portion such that the internal cutting member and/or the external cutting member may be removed from the cover portion, e.g. by having a hinge mechanism by means of which the holding component is pivotally connected to the cover portion According to the invention a new set-up for the transfer of external loads, exerted on the external cutting members during use, from the external cutting members to the housing is provided in the cutting units of the shaving unit. According to the invention, in each cutting unit the external cutting member, in the closed condition of the housing, is directly supported by the base portion of the housing accommodating the hair collection chamber. This direct support is achieved in that the base portion of the housing of each cutting unit comprises a supporting structure, wherein in the closed position of the housing the external cutting member is supported by the supporting structure at least in an axial direction parallel to the axis of rotation. As a result of this supporting structure, any external load exerted on the external cutting member in the closed condition of the housing, i.e. during normal operation of the shaving unit, is directly transferred from the external cutting member to the supporting structure and via the supporting structure to the base portion of the housing. It is to be understood that, according to the invention, the external cutting member is supported by the supporting structure at least in the axial direction parallel to the axis of rotation, which is the main direction into which external loads are exerted on the external cutting member during use. It is to be further understood that the supporting structure directly supports the external cutting member, i.e. a supporting force is directly exerted by the supporting structure on the external cutting member. The external load exerted on the external cutting member is no longer transferred to the holding component, although it is to be understood that in certain conditions the holding component may still be loaded with a minor part of the external load. As a result, the holding component does not need to have a relatively rigid structure, and also the coupling structure for the releasable coupling of the holding component to the cover portion does not need to have a relatively rigid structure. As a result, the holding component and its coupling structure may have a relatively simple and easy-to-handle layout and structure. The coupling structure may e.g. comprise a simple snap connection, which can be released by a relatively low manual force. As a result, the demounting and mounting of the internal cutting member and the external cutting member from the cover portion by the user is simplified. Furthermore, because the external loads are directly transferred from the external cutting member to the base portion of the housing via the supporting structure, a relatively rigid and stable support of the external cutting member in the cutting unit is achieved.

The supporting structure may be formed integral with the base portion of the housing, e.g. by means of an injection molding process. The supporting structure may be provided as a plurality of separate supporting members, like e.g. a plurality of separate posts or supporting segments each with a limited angular extension about the axis of rotation, like e.g. an angular extension of less than 10°. As a result, the space available for collecting cut-off hairs in the hair collection chamber is reduced by the presence of the supporting structure only to a limited extent. In particular, the supporting structure may be designed such that the presence of the supporting structure does not hinder the cleaning of the hair collection chamber.

Whilst the supporting structure is adapted to carry external forces exerted on the external cutting member in the axial direction parallel to the axis of rotation, it is to be understood that external forces exerted on the external cutting member in different directions, like e.g. in a radial direction or in a tangential direction with respect to the axis of rotation, may also be carried by the support structure. In particular, the support structure might support and engage the external cutting member in such a way as to fix the external cutting member in a predetermined position with respect to the housing.

In a preferred embodiment of the shaving unit according to the invention, in each cutting unit the cover portion of the housing is pivotally coupled to the base portion of the housing by means of a first hinge mechanism. According to this preferred embodiment, the cover portion is pivotally coupled to the base portion of the housing, such that it is possible to easily open the housing of the cutting unit, in order to access the hair collection chamber, by pivoting the cover portion relative to the base portion. In addition, a detachable coupling structure may be present to lock the cover portion relative to the base portion in the closed position of the housing.

In a further embodiment, in each cutting unit the holding component is pivotally coupled to the cover portion of the housing by means of a second hinge mechanism. According to this embodiment, the holding component is pivotal in relation to the cover portion of the housing. As a result, after opening the housing by removing or pivoting the cover portion, a user can easily remove the internal cutting member and/or the external cutting member from the cover portion by pivoting the holding component relative to the cover portion. As a result, the procedure of mounting and demounting of the cutting members is further simplified. In addition, a detachable coupling structure may be present to lock the holding component relative to the cover portion in the position of the holding component wherein it holds the cutting members relative to the cover portion during normal use.

In a further preferred embodiment, the supporting structure has an abutment structure providing, in the closed condition of the housing, a form-locking engagement with the external cutting member in the axial direction. According to this embodiment, the supporting structure fixes the external cutting member in a predetermined position in relation to the housing, at least in the axial direction with respect to the axis of rotation, by a form-locking engagement with the external cutting member. This form-locking engagement is accomplished by an abutment structure, e.g. comprising one or more abutment surfaces on both the supporting structure and the external cutting member in contact with each other in the closed condition of the housing. The abutment structure is arranged such that an axial force, resulting from a contact pressure exerted by the skin on the external cutting member during use in a direction parallel to the axis of rotation, is transferred from the external cutting member to the supporting structure and further to the base portion of the housing. Preferably, in the closed condition of the housing, the abutment structure also provides a form-locking engagement with the external cutting member in a radial direction perpendicular to the axis of rotation. As a result, also forces exerted on the external cutting member in a radial direction relative to the axis of rotation can be transferred by the abutment structure. For this purpose the abutment structure may comprise one or more additional abutment surfaces on both the supporting structure and the external cutting member in contact with each other in the closed condition of the housing. As a result, during use the external cutting member is held in a coaxial position relative to the axis of rotation by the abutment structure. In particular, this form-locking engagement may provide a positioning in such a way that the external cutting member and the internal cutting member are held and guided in a coaxial alignment with respect to the axis of rotation.

In a preferred embodiment, the abutment structure comprises at least one abutting surface extending substantially perpendicularly with respect to the axis of rotation and facing towards the external cutting member in the closed condition of the housing. According to this embodiment, an axial abutting surface, i.e. an abutting surface extending substantially perpendicularly with respect to the axis of rotation, is provided on the supporting structure, which faces towards the external cutting member and e.g. abuts a cooperating axial abutment surface provided on the external cutting member. An axial abutting surface is understood to be a surface lying in a plane which is oriented perpendicularly to the axis of rotation, such that forces in the axial direction parallel to the axis of rotation can be transferred by said axial abutting surfaces by pressing the axial abutting surfaces into direct contact with each other.

In a preferred embodiment, the abutment structure comprises a plurality of abutting surfaces each extending substantially perpendicularly with respect to the axis of rotation and each facing towards the external cutting member in the closed condition of the housing, wherein the abutting surfaces are arranged with distances between each other around the axis of rotation. According to this embodiment, the supporting structure comprises a number of abutting surfaces which are arranged with a distance between each other around the axis of rotation, in particular in such a way that each abutting surface extends over a limited angular range relative to the axis of rotation and the abutting surfaces are separated from each other by interspaces wherein no support function is provided for the external cutting member. In particular, the abutting surfaces may be distributed evenly around the axis of rotation, such that e.g. three abutting surfaces are distanced from each other by 120° or four abutting surfaces are distanced from each other by 90°. In this embodiment, the space available for collecting cut-off hairs in the hair collection chamber is reduced by the presence of the supporting structure only to a limited extent. By providing at least three abutting surfaces at a distance from each other, a stable support of the external cutting member by the supporting structure is provided.

In a further embodiment of a shaving unit according to the invention, the base portion comprises a bottom wall and that the supporting structure is provided on an inner side of the bottom wall. According to this embodiment, the supporting structure may at least partially be located within the hair collection chamber, at least in embodiments wherein the hair collecting chamber is delimited by the bottom wall and side walls of the base portion of the housing. The supporting structure might be integrally formed with the base portion of the housing, e.g. by means of an injection molding process.

The arrangement of the supporting structure on the inner side of the bottom wall of the housing provides an improved stability of the supporting structure.

In a further preferred embodiment, the bottom wall comprises a central opening and the supporting structure is arranged around the central opening in a radial position, relative to the axis of rotation, outward of the central opening. According to this embodiment, the bottom wall of the housing comprises an opening which is preferably positioned in a center portion of the bottom wall, preferably in a position around the axis of rotation of the internal cutting member. The opening may serve to allow the coupling of a drive spindle with the internal cutting member to transfer a rotational movement and torque from a drive unit of the shaving unit to the internal cutting member. The opening may further serve to allow flush water to enter from the bottom side of the housing into the hair collection chamber. Because the supporting structure is arranged around the central opening in a radial position, relative to the axis of rotation, outward of the central opening, the support structure is arranged at a larger radial distance from the axis of rotation than the outer boundary of the central opening in the bottom wall. As a result, the supporting structure has an improved stability.

In a further embodiment of a shaving unit according to the invention, the shaving unit has a central support member and the cutting units are each pivotable relative to the central support member about a pivot axis. In particular the cutting units may be pivotal relative to the central support member individually and independently from each other, e.g. in that a first one of the cutting units is pivotally mounted to the central support member about a first pivot axis and a second one of the cutting units is pivotally mounted to the central support member about a second pivot axis different from the first pivot axis. Preferably, the pivot axis of each cutting unit is provided by a pivot structure by means of which the base portion of the housing of the cutting unit is connected to the central support member. It is to be understood that, e.g. in an embodiment wherein the shaving unit has two cutting units, the pivot axes of the two cutting units may be coincident and in particular may be positioned between the cutting units such as to provide a compact structure of the shaving unit and a convenient and efficient contour-following property of the shaving unit by the pivotal movements of the cutting units. It is noted that, also in such embodiments wherein the pivot axes of two cutting units coincide, the pivotal movements of the two cutting units may be individual and independent from each other. Further cutting units may be present in the shaving unit according to the invention, e.g. a third cutting unit which is pivotal about a third pivot axis. The third pivot axis may be oriented perpendicularly to the first and second pivot axes when the first and second pivot axes are parallel or coincident.

In a further embodiment of a shaving unit comprising a central support member, the central support member comprises a coupling member by means of which the shaving unit can be releasably coupled to a main housing of the shaving apparatus. The central support member may accommodate a single central drive shaft, which is coupled to an output shaft of an electric motor accommodated in the main housing when the shaving unit is coupled to the main housing by means of the coupling member. The single central drive shaft may be connected to a central transmission element of a transmission unit of the shaving unit, which is arranged to drive at least two driven transmission elements which are each coupled, for example via a drive spindle, to the internal cutting member of one of the respective cutting units.

A further aspect of the invention is a shaving apparatus comprising a main housing accommodating a motor, and comprising a shaving unit according to the invention as described beforehand. Preferably, the shaving unit is releasably coupled to the main housing by means of a coupling member. Said shaving apparatus may incorporate in said main housing a drive unit, like an electric motor, for driving the cutting units when the shaving unit is coupled to the main housing. The coupling member of the shaving unit may be centrally arranged in the shaving unit. The drive unit may drive the cutting units via a single central drive shaft accommodated in the coupling member of the shaving unit. The coupling member may comprise a suitable coupling structure adapted to mutually couple and decouple the main housing and the shaving unit. The coupling member may be provided on a central support member of the shaving unit which supports the cutting units.

It shall be understood that the shaving unit according to the invention and the shaving apparatus according to the invention may have similar and/or identical preferred embodiments, in particular as defined in the dependent claims.

It shall be understood that a preferred embodiment of the present invention can also be any combination of the dependent claims or above embodiments with the respective independent claim.

These and other aspects of the invention will be apparent from and elucidated with reference to the embodiments described hereinafter.

BRIEF DESCRIPTION OF THE DRAWINGS

Preferred embodiments of the invention are described with reference to the drawings.

In the drawings.

DETAILED DESCRIPTION OF THE EMBODIMENTS

Figure 1A:
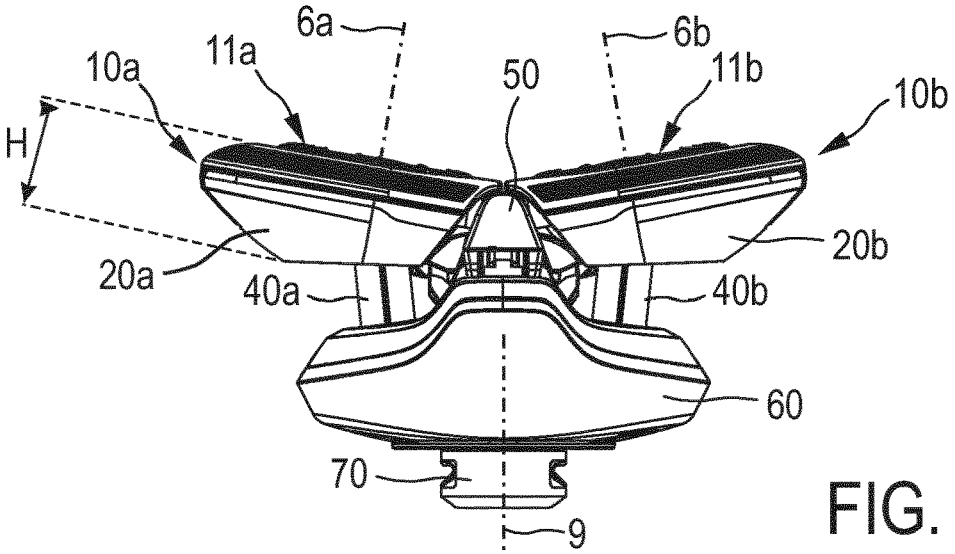
FIGS. 1*a*-1*c* show a frontal view of three pivoted configurations of a shaving unit according to a first embodiment of the invention.
Figure 1B:
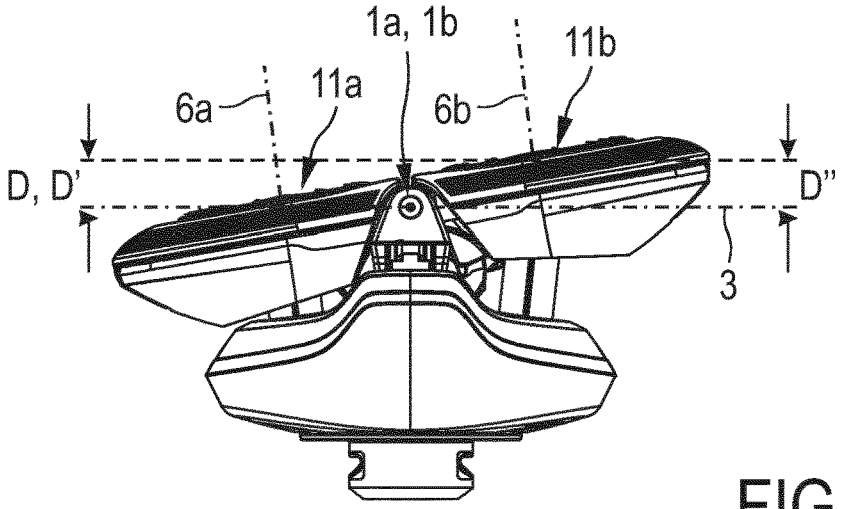
Figure 1C:
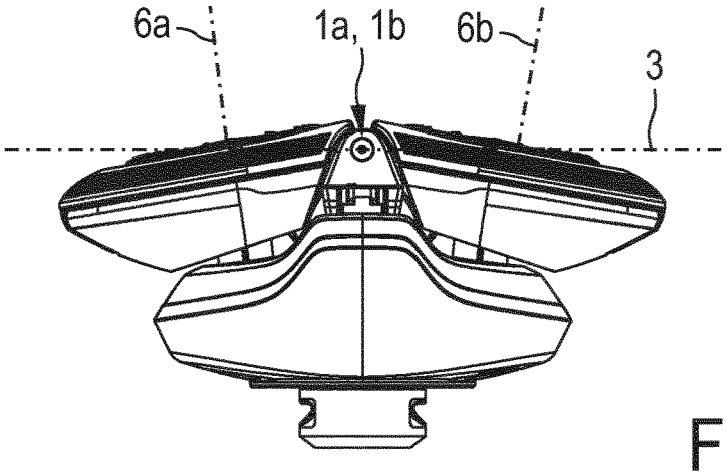

With reference to FIGS. 1*a*-1*c* a shaving unit for a shaving apparatus according to the invention is shown. The shaving unit has two cutting units, i.e. a first cutting unit 10*a* and a second cutting unit 10*b*, which are shown in three different pivoted positions with respect to each other. Each cutting unit 10*a*, 10*b* comprises an external cutting member 12, which is partially visible in FIG. 3. The external cutting member 12 comprises a plurality of hair entry openings 13, e.g. in the form of elongated slits. Via the hair entry openings 13, hairs present on the skin can enter the cutting units 10*a*, *b*. The hair entry openings 13 define a first shaving track 11*a* of the first cutting unit 10*a* and a second shaving track 11*b* of the second cutting unit 10*b*. In FIGS. 1*a*-1*c* the shaving tracks 11*a*, 11*b* are partially visible as protruding relative to, respectively, an upper surface of a first housing 20*a* of the first cutting unit 10*a* and an upper surface of a second housing 20*b* of the second cutting unit 10*b*. Each cutting unit 10*a*, 10*b* further comprises an internal cutting member, which is accommodated in the respective housing 20*a*, 20*b* and rotatable relative to the external cutting member 12 about a respective first and second axis of rotation 6*a*, 6*b*. The internal cutting members of the cutting units 10*a*, 10*b* are not visible in the FIGS. 1*a*-1*c*. They may have a structure with a plurality of cutting elements, as is well known for the person skilled in the art, and will not be described in further detail. Each internal cutting member is coupled via a respective drive spindle 40*a*, 40*b* to a transmission unit 60 of the shaving unit. The transmission unit 60 may comprise a set of transmission gear wheels for transmitting the rotational motion of a central drive shaft, which is rotatable about a main drive axis 9, into rotational motions of the drive spindles 40*a*, 40*b*. The central drive shaft, which is not visible in FIGS. 1*a*-1*c*, is accommodated in a coupling member 70 of the shaving unit. By means of the coupling member 70, the shaving unit can be releasbly coupled to a main housing of the shaving apparatus, which is also not shown in the figures. The coupling member 70 is part of a central support member 50 of the shaving unit. The central support member 50 supports the first and second cutting units 10*a*, 10*b*.

Figure 6:
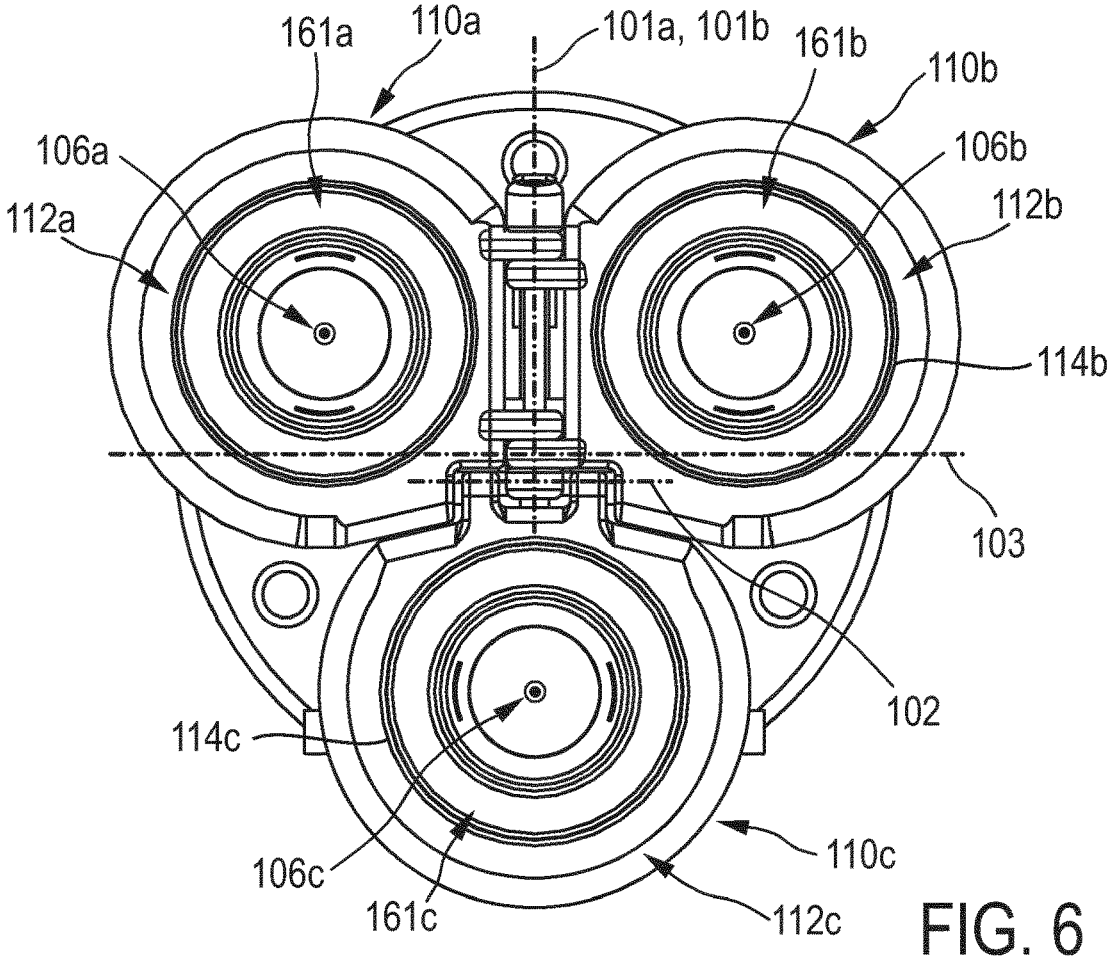
FIG. 6 shows a top view of the shaving unit of FIG. 5.

The first housing 20*a* of the first cutting unit 10*a* is pivotally mounted to the central support member 50 by means of a first primary pivot axis 1*a*, and the second housing 20*b* of the second cutting unit 10*b* is pivotally mounted to the central support member 50 by means of a second primary pivot axis 1*b*. In the embodiment shown in FIGS. 1*a*-1*c*, the first and second primary pivot axes 1*a*, 1*b* coincide. The primary pivot axes 1*a*, 1*b* may also be non-coincident, i.e. they may constitute two separate parallel or non-parallel primary pivot axes about which the first and second cutting units 10*a*, 10*b* are pivotal relative to the central support member 50, respectively. In the embodiment shown in FIGS. 1*a*-1*c*, the first and second primary pivot axis 1*a*, 1*c* are arranged between the first and second axes of rotation 6*a*, 6*b* of the internal cutting members. More particular, seen in a direction parallel to the first axis of rotation 6*a*, the first primary pivot axis 1*a* is arranged between the first shaving track 11*a* and the second axis of rotation 6*b* and, seen in a direction parallel to the second axis of rotation 6*b*, the second primary pivot axis 1*b* is arranged between the second shaving track 11*b* and the first axis of rotation 6*a*. Such an arrangement of the primary pivot axes 1*a*, 1*b* is shown in FIGS. 1*a*-1*c*. Such an arrangement of the primary pivot axes 101*a*, 101*b* is also visible in the embodiment of the shaving unit as shown in FIG. 6, which will be further described hereinafter. In the embodiments of the shaving unit shown in FIGS. 1*a*-1*c* and in FIG. 6, seen in directions parallel to the first and second axes of rotation 6*a*, 6*b*, the first and second primary pivot axes 1*a*, 1*b*; 101*a*, 101*b* are in particular arranged between the external cutting members 12; 114*a*, 114*b* of the cutting units 10*a*, 10*b*; 110*a*, 110*b*, respectively. However, in an alternative embodiment of a shaving unit according to the invention, the primary pivot axes may be arranged in positions which are not or not fully between the external cutting members of the cutting units, e.g. in positions wherein the primary pivot axes cross the external cutting members in circumferential areas of the external cutting members. In the embodiment shown in FIGS. 1*a*-1*c*, however, the first primary pivot axis 1*a* is arranged between the first shaving track 11*a* and the second axis of rotation 6*b*, and the second primary pivot axis 1*b* is arranged between the second shaving track 11*b* and the first axis of rotation 6*a*. I.e. the first primary pivot axis 1*a* is positioned outwardly from the first shaving track 11*a* in a radial direction with respect to the first axis of rotation 6*a*, and consequently does not cross or cover any of the hair entry openings 13 of the external cutting member 12 of the first cutting unit 10*a*, seen in the direction of the first axis of rotation 6*a*. The same applies for the second primary pivot axis 1*b* relative to the second shaving track 11*b* and the second axis of rotation 6*b*. Furthermore, the primary pivot axes 1*a*, 1*b* each extend parallel to a plane wherein, respectively, the first and second shaving tracks 11*a*, 11*b* extend.

As will be described further in detail in the following, the central support member 50 comprises a stationary portion, which comprises the coupling member 70, and a movable portion. The first and second housings 20*a*, 20*b* of the cutting units 10*a*, 10*b* are pivotal about the first and second primary pivot axes 1*a*, 1*b* relative to the movable portion of the central support member 50. The movable portion of the central support member 50 is pivotal relative to the stationary portion of the central support member 50 about a secondary pivot axis 3 as indicated in FIGS. 1*a*-1*c*. In general, the secondary pivot axis 3 is not parallel to the first and second primary pivot axes 1*a*, 1*b*. In the embodiment shown in FIGS. 1*a*-1*c*, wherein the first and second primary pivot axes 1*a*, 1*c* coincide, the secondary pivot axis 3 extends perpendicularly to the coinciding first and second primary pivot axes 1*a*, 1*b*.

FIG. 1*a* shows the first and second cutting units 10*a*, 10*b* in a spring-biased neutral pivoted position, wherein the first cutting unit 10*a* is pivoted about the first primary pivot axis 1*a* in a clockwise direction into a maximum pivot angle, delimited by a mechanical stop not shown in the figures, and wherein the second cutting unit 10*b* is pivoted about the second primary pivot axis 1*b* in an anti-clockwise direction to a maximum pivot angle, which is also delimited by a mechanical stop not shown in the figures. These pivoted positions of the first and second cutting units 10*a*, 10*b* result in a concave V-shaped configuration of the first and second cutting units 10*a*, 10*b* and the first and second shaving tracks 11*a*, 11*b*.

FIG. 1*b* shows pivoted positions of the cutting units 10*a*, 10*b*, wherein the first and the second cutting units 10*a*, 10*b* are both pivoted about the primary pivot axes 1*a*, 1*b* in an anti-clockwise direction. In these pivoted positions of the cutting units 10*a*, 10*b*, the first and second shaving tracks 11*a*, 11*b* extend in a common plane shape which is oriented obliquely in relation to the main drive axis 9.

FIG. 1*c* shows pivoted positions of the cutting units 10*a*, 10*b*, wherein the first cutting unit 10*a* is pivoted about the first primary pivot axis 1*a* in an anti-clockwise direction, while the second cutting unit 10*b* is pivoted about the second primary pivot axis 1*b* in a clockwise direction. These pivoted positions of the cutting units 10*a*, 10*b* result in a convex V-shaped configuration of the first and second cutting units 10*a*, 10*b* and the first and second shaving tracks 11*a*, 11*b*. It is to be understood that the pivoted positions of the cutting units 10*a*, 10*b* shown in FIGS. 1*a*-1*c* are possible because the cutting units 10*a*, 10*b* are individually and mutually independently pivotal about the primary pivot axes 1*a*, 1*b*. I.e. the first cutting unit 10*a* can perform any pivotal motion about the first primary pivot axis 1*a* independently of any pivotal motion of the second cutting unit 10*b* about the second primary pivot axis 1*b*, and v.v.

Figure 2A:
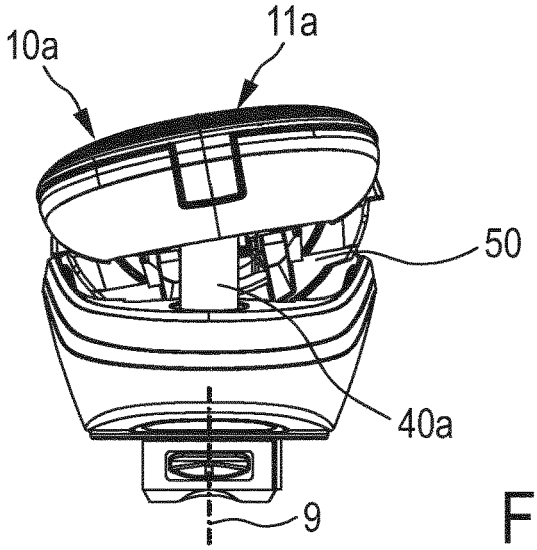
FIGS. 2*a*-2*c* show a side view of three pivoted configurations of the shaving unit of FIGS. 1*a*-1*c;*
Figure 2B:
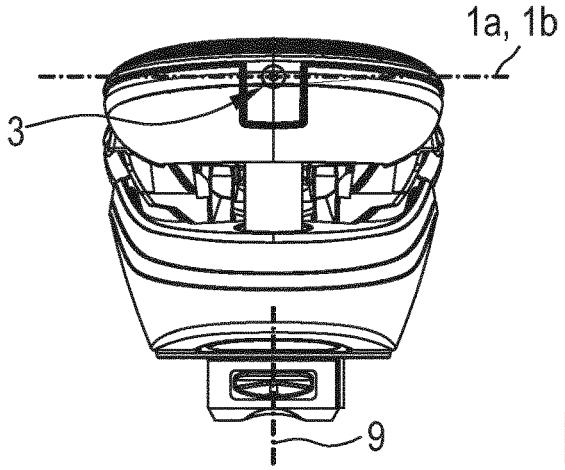
Figure 2C:
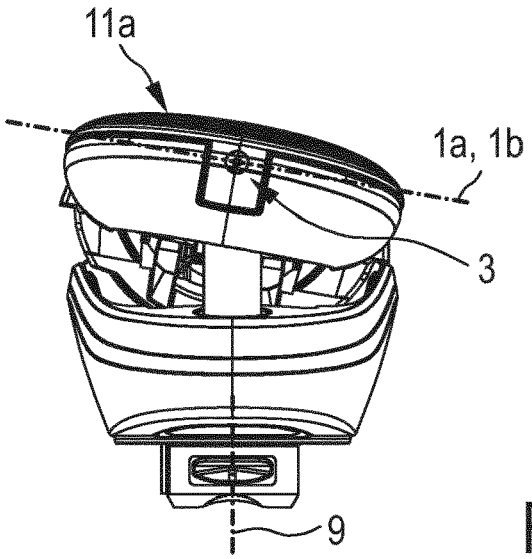

FIGS. 2*a*-2*c* show a side view of the first and second cutting units 10*a*, 10*b* in three different pivoted positions about the secondary pivot axis 3. In FIG. 2*a* the movable portion of the central support member 50, with the cutting units 10*a*, 10*b* connected thereto via the primary pivot axes 1*a*, 1*b*, is pivoted relative to the stationary portion of the central support member 50 in an anti-clockwise direction about the secondary pivot axis 3. FIG. 2*b* shows a neutral position of the movable portion with no pivoting of the cutting units 10*a*, 10*b* about the secondary pivot axis 3. FIG. 2*c* shows a third pivoted configuration wherein the movable portion of the central support member 50, with the cutting units 10*a*, 10*b* connected thereto via the primary pivot axes 1*a*, 1*b*, is pivoted relative to the stationary portion of the central support member 50 in a clockwise direction about the secondary pivot axis 3.

Figure 3:
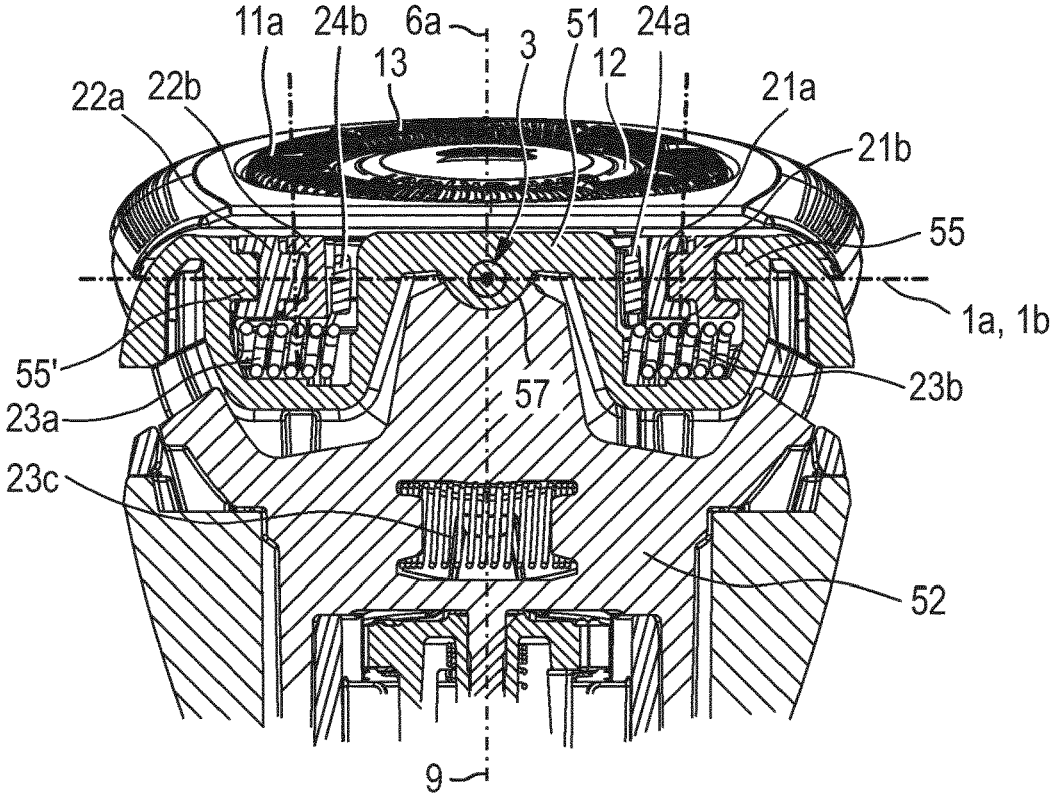
FIG. 3 shows a cross-sectional view of the shaving unit of FIGS. 1*a*-1*c* along the line 1 in FIG. 4.

FIG. 3 shows a cross-sectional view of the shaving unit shown in FIGS. 1*a*-1*c*, and FIG. 4 shows a top view of said shaving unit with parts of the cutting units 10*a*, 10*b* being removed. As can be seen in these figures, both the coinciding primary pivot axes 1*a*, 1*b* and the secondary pivot axis 3 extend in a direction perpendicular to the main drive axis 9 in a non-pivoted position of the cutting units 10*a*, 10*b* about the primary pivot axes 1*a*, 1*b* and the secondary pivot axis 3.

Figure 4:
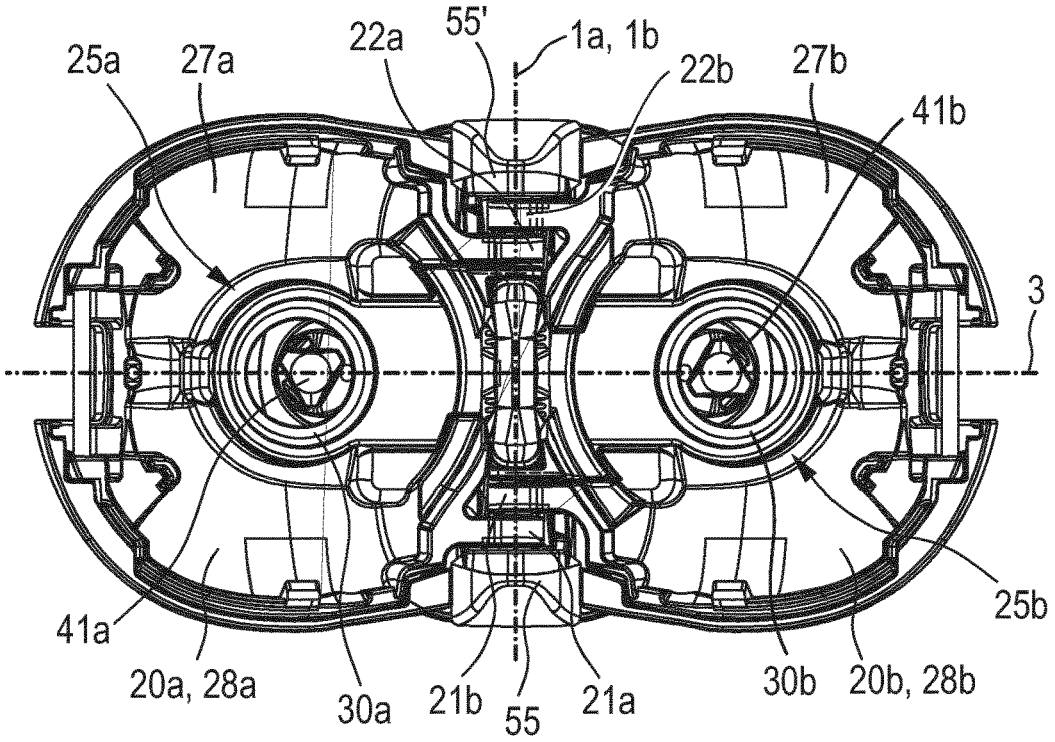
FIG. 4 shows a partial cut away top view of the shaving unit of FIGS. 1*a*-1*c;*

As shown in FIG. 4, the first housing 20*a* of the first cutting unit 10*a* accommodates a first hair collecting chamber 27*a*, and the second housing 20*b* of the second cutting unit 10*b* accommodates a second hair collecting chamber 27*b*. The first and second hair collecting chambers 27*a*, 27*b* each have an annular shape. The first hair collecting chamber 27*a* surrounds a central opening 25*a* which is provided in a bottom wall 28*a* of the first housing 20*a*. Likewise, the second hair collecting chamber 27*b* surrounds a central opening 25*b* which is provided in a bottom wall 28*b* of the second housing 20*b*. As can be seen in FIG. 4, coupling elements 41*a*, 41*b*, which are provided on upper end portions of, respectively, the drive spindles 40*a*, 40*b*, extend through, respectively, the openings 25*a*, 25*b*. In the assembled condition of the cutting units 10*a*, 10*b*, the coupling elements 41*a*, 41*b* engage the internal cutting members of, respectively, the first cutting unit 10*a* and the second cutting unit 10*b* to transfer a rotational motion of the drive spindles 40*a*, 40*b* to the internal cutting members. It is to be understood that the internal cutting members and the external cutting members of the cutting units 10*a*, 10*b* are not shown in FIG. 4, while in FIG. 3 only the external cutting member 12 of the first cutting unit 10*a* is visible.

As shown in FIGS. 3 and 4, the coinciding first and second primary pivot axes 1*a*, 1*b* are defined by a first hinge structure, which mutually connects the first housing 20*a* and the second housing 20*b*, and by a second hinge structure, which connects an assembly of the mutually connected first and second housings 20*a*, 20*b* to the movable portion 51 of the central support member 50. FIG. 3 further shows the stationary portion 52 of the central support member 50. Said first and second hinge structures have coinciding hinge axes. The first hinge structure comprises cooperating first and second hinge elements 21*a*, 21*b*, which are connected to, respectively, the first housing 20*a* and the second housing 20*b*, and cooperating third and fourth hinge elements 22*a*, 22*b*, which are connected to, respectively, the first housing 20*a* and the second housing 20*b*. A bearing pin formed on the second hinge element 21*b* engages a bearing cavity formed in the first hinge element 21*a*, and a bearing pin formed on the third hinge element 22*a* engages a bearing cavity formed in the fourth hinge element 22*b*. The second hinge structure comprises two bearing pins 55 and 55' which are integrally formed on the moveable portion 51 of the central support member 50. The two bearing pins 55 and 55' are arranged coaxially and face each other. The bearing pin 55 engages a bearing cavity, which is formed in the second hinge element 21*b* and is arranged coaxially with the bearing pin formed on the second hinge element 21*b*. The bearing pin 55' engages a bearing cavity, which is formed in the third hinge element 22*a* and is arranged coaxially with the bearing pin formed on the third hinge element 22*a*. The first and second hinge structures, comprising the hinge elements 21*a*, 21*b*, 22*a*, 22*b* formed on the housings 20*a*, 20*b* and the two bearing pins 55, 55', formed on the movable portion 51 of the central support member 50, provide the coincident primary pivot axes 1*a*, 1*b* in a simple and robust manner. During assembly of the shaving unit, the hinge elements 21*a*, 21*b* and 22*a*, 22*b* can be simply snapped into each other thereby forming an assembly of the first and second housings 20*a*, 20*b*. Subsequently said assembly can be simply snapped in between the two bearing pins 55, 55'. Finally, as shown in FIG. 3, filling elements 24*a*, 24*b* may be arranged between, respectively, the hinge elements 21*a*, 22*b* and the movable portion 51 of the central support member 50 to fill the gaps which are required for assembling the first and second hinge structures. The filling elements 24*a*, 24*b* prevent unintentional disassembling of the first and second hinge structures during use of the shaving unit.

The bearing pins 55, 55' define the position of the coinciding primary pivot axes 1*a*, 1*b* relative to the housings 20*a*, 20*b*. The bearing pins 55, 55' are arranged between the housings 20*a*, 20*b*, seen in directions parallel to the axes of rotation 6*a*, 6*b* of the cutting units 10*a*, 10*b* as e.g. in FIG. 4. As can further be seen in FIGS. 1*a* and 1*b*, seen in a direction parallel to the secondary pivot axis 3, in the neutral pivoted position of the first cutting unit 10*a* (FIG. 1*a*) the first primary pivot axis 1*a* is arranged between a skin contact surface of the first shaving track 11*a* and a bottom of the first housing 20*a*. Similarly, seen in a direction parallel to the secondary pivot axis 3, in the neutral pivoted position of the second cutting unit 10*b* (FIG. 1*b*) the second primary pivot axis 1*b* is arranged between a skin contact surface of the second shaving track 11*b* and a bottom of the second housing 20*b*. The first and second housings 20*a*, 20*b* each have an identical height H, seen in respective directions parallel to the first axis of rotation 6*a* and parallel to the second axis of rotation 6*b*. In an intermediate pivoted position of the cutting units 10*a*, 10*b* between the pivoted positions as shown in FIGS. 1*a* and 1*c*, wherein the first and second shaving tracks 11*a*, 11*b* extend in a common plane, a distance D between the first primary pivot axis 1*a* and the skin contact surface of the first shaving track 11*a*, in particular measured in a central imaginary plane comprising the first primary pivot axis 1*a* and the central drive axis 9, is smaller than 50% of the height H. Likewise, in said intermediate pivoted position of the cutting units 10*a*, 10*b*, a distance D' between the second primary pivot axis 1*b* and the skin contact surface of the second shaving track 11*b*, in particular measured in a central imaginary plane comprising the second primary pivot axis 1*b* and the central drive axis 9, is smaller than 50% of the height H.

The movable portion 51 of the central support member 50 is pivotally guided along a curved path 57 relative to the stationary portion 52 of the central support member 50. Seen in the cross-sectional view of the shaving unit in FIG. 3, the curved path 57 comprises a circle segment having a radius and a center point, which defines the position of the secondary pivot axis 3 as a virtual axis. The secondary pivot axis 3 extends perpendicularly to the coinciding primary pivot axes 1*a*, 1*b* and lies approximately in a common plane with the coinciding primary pivot axes 1*a*, 1*b*. Said common plane extends approximately parallel to the skin contact surfaces of the first shaving track 11*a* and the second shaving track 11*b* in an intermediate pivoted position of the cutting units 10*a*, 10*b* between the pivoted positions as shown in FIGS. 1*a* and 1*c*, wherein the first and second shaving tracks 11*a*, 11*b* extend in a common plane. As a result, in said intermediate pivoted position of the cutting units 10*a*, 10*b*, a distance D" between the secondary pivot axis 3 and the skin contact surfaces of the first and second shaving tracks 11*a*, 11*b*, in particular measured in a central imaginary plane comprising the secondary pivot axis 3 and the central drive axis 9, is equal to the distances D, D' between the coinciding primary pivot axes 1*a*, 1*b* and the skin contact surfaces of the first and second shaving tracks 11*a*, 11*b* as shown in FIG. 1*b*, i.e. said distance D" is smaller than 50% of the height H of the housings 20*a*, 20*b* of the cutting units 10*a*, 10*b*. It will be clear that, in embodiments wherein the secondary pivot axis 3 and the primary pivot axes 1*a*, 1*b* do not extend in a common plane, the distance D" may be different from the distances D, D'.

As can be further seen in FIG. 3, two spring elements 23*a*, 23*b* are arranged below the coinciding primary pivot axes 1*a*, 1*b* in the movable portion 51 of the central support member 50. The spring elements 23*a*, 23*b* exert a spring load on the housings 20*a*, 20*b* of the cutting units 10*a*, 10*b* such as to bias the cutting units 10*a*, 10*b* in their concave pivoted positions as shown in FIG. 1*a*, wherein the skin contact surfaces of the shaving tracks 11*a*, 11*b* have a V-shaped geometry. It is to be understood that, in variations of the embodiment of the shaving unit, the spring elements may bias the cutting units 10*a*, 10*b* into different pivoted positions, e.g. into pivoted positions wherein the skin contact surfaces of the shaving tracks 11*a*, 11*b* extend in a common plane and, thus, have a flat geometry, or into pivoted positions wherein the skin contact surfaces of the shaving tracks 11*a*, 11*b* have a convex geometry.

Furthermore, the assembly of the cutting units 10*a*, 10*b* is biased into a neutral pivoted position relative to the secondary pivot axis 3 by a further spring element 23*c*. The further spring element 23*c* is arranged in the stationary portion 52 of the central support member 50 and exerts a biasing force on the movable portion 51 of the central support member 50. Starting from the neutral pivoted position relative to the secondary pivot axis 3 as shown in FIG. 3, the assembly of the cutting units 10*a*, 10*b* may conduct a pivotal movement in a clockwise direction or in an anti-clockwise direction about the secondary pivot axis 3.

FIGS. 5-8 show a shaving unit according to a second embodiment of the invention. This shaving unit comprises three cutting units, i.e. a first cutting unit 110*a*, a second cutting unit 110*b*, and a third cutting unit 110*c*. Each of the three cutting units 110*a*, 110*b*, 110*c* comprises a housing 120*a*, 120*b*, 120*c*, an external cutting member 114*a*, 114*b*, 114*c* with a plurality of hair entry openings which define an annular shaving track 161*a*, 161*b*, 161*c*, and an internal cutting member (not shown in detail in the figures) which is rotatable relative to the external cutting member 114*a*, 114*b*, 114*c* about an axis of rotation 106*a*, 106*b*, 106*c* and which is arranged in the housing 120*a*, 120*b*, 120*c*. The annular shaving tracks 161*a*, 161*b*, 161*c* each have a skin contact surface. The external cutting members 114*a*, 114*b*, 114*c* are each arranged in and held by an annular cover portion 112*a*, 112*b*, 112*c* of, respectively, the housings 120*a*, 120*b*, 120*c*. Each of the cover portions 112*a*, 112*b*, 112*c* also has a skin contact surface surrounding the skin contact surface of the associated shaving track 161*a*, 161*b*, 161*c*. The housings 120*a*, 120*b*, 120*c* each accommodate a hair collecting chamber.

The first cutting unit 110*a* and the second cutting unit 110*b* are pivotal relative to a central support member 150 of the shaving unit about, respectively, a first primary pivot axis 101*a* and a second primary pivot axis 101*b*. Like the first and second primary pivot axes 1*a*, 1*b* in the embodiment of the shaving unit shown in FIGS. 1-4, the first and second primary pivot axes 101*a*, 101*b* are arranged as coinciding first and second primary pivot axes. By means of the first and second primary pivot axes 101*a*, 101*b*, the first and second cutting units 110*a*, 110*b* are pivotal relative to a movable portion 151 of the central support member 150. The coincident first and second primary pivot axes 101*a*, 101*b* are realized by similar hinge structures used to realize the coinciding first and second primary pivot axes 1*a*, 1*b* in the embodiment of FIGS. 3-4.

The third cutting unit 110*c* is pivotal relative to the central support member 150 about a third primary pivot axis 102, which extends perpendicularly to the coinciding first and second pivot axes 101*a*, 101*b*. Seen in a direction parallel to the axis of rotation 106*c* of the third cutting unit 110*c*, the third primary pivot axis 102 is arranged between the shaving track 161*c* of the third cutting unit 110*c* and the axes of rotation 106*a*, 106*b* of the first and second cutting units 110*a*, 110*b*, as is shown in FIG. 6. Seen in the direction parallel to the axis of rotation 106*c* of the third cutting unit 110*c*, the third primary pivot axis 102 is in particular arranged between the external cutting member 114*c* of the third cutting unit 110*c* and the axes of rotation 106*a*, 106*b* of the first and second cutting units 110*a*, 110*b*. However, in alternative embodiments, the third primary pivot axis 102 may be arranged in a position which is not or not fully between the external cutting member 114*c* of the third cutting unit 110*c* and the axes of rotation 106*a*, 106*b* of the first and second cutting units 110*a*, 110*b*, e.g. in a position wherein the third primary pivot axis 102 crosses the external cutting member 114*c* of the third cutting unit 110*c* in a circumferential area thereof. In such alternative embodiments, the third primary pivot axis 102 may still be arranged between the shaving track 161*c* of the third cutting unit 110*c* and the axes of rotation 106*a*, 106*b* of the first and second cutting units 110*a*, 110*b*, i.e. arranged outwardly from the shaving track 161*c* of the third cutting unit 110*c* in a radial direction with respect to the axis of rotation 106*c* of the third cutting unit 110*c* and, consequently, not crossing or covering any of the hair entry openings of the external cutting member 114*c* of the third cutting unit 110*c*, seen in the direction of the axis of rotation 106*c* of the third cutting unit 110*c*.

Figure 7:
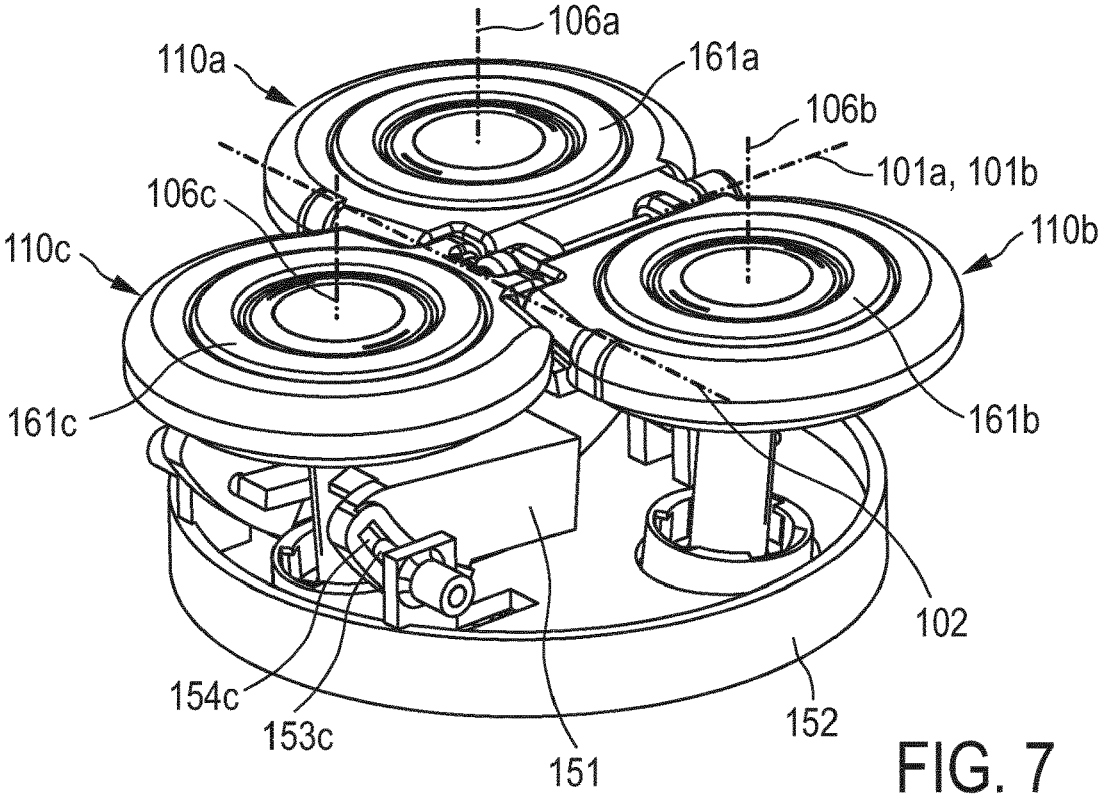
FIG. 7 shows a perspective, partially cut away upper-frontal view of the shaving unit of FIG. 5.
Figure 8:
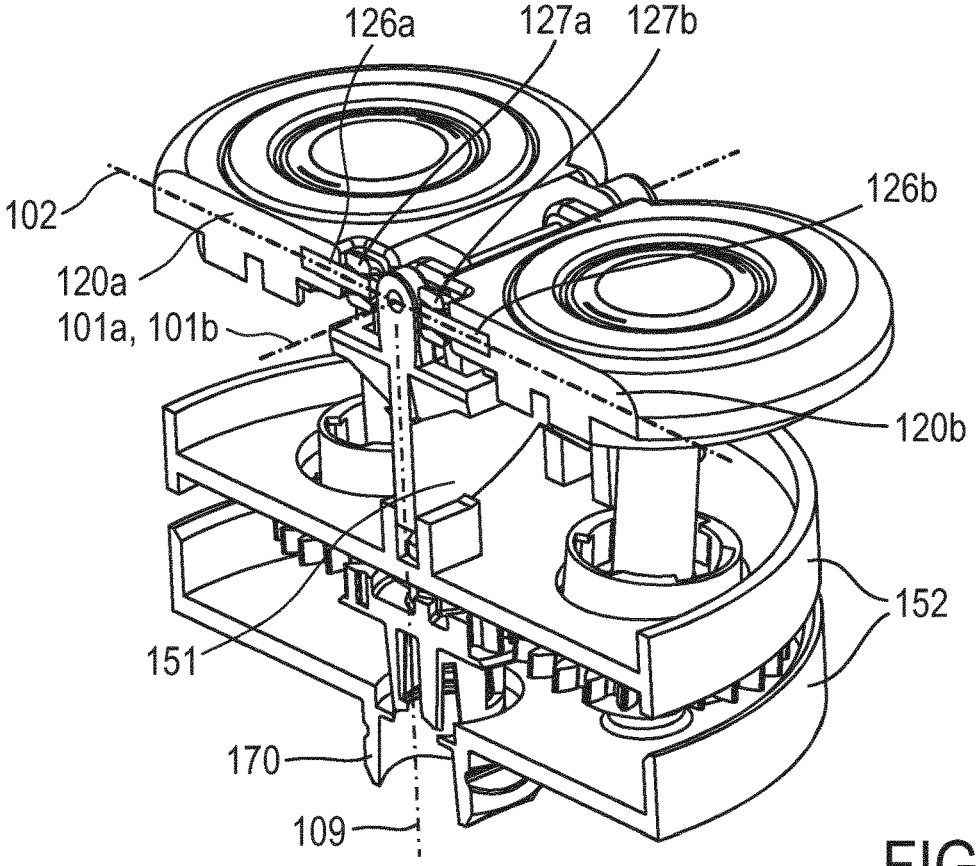
FIG. 8 shows a partial cut away perspective view of the shaving unit as shown in FIG. 7.

In the embodiment of the shaving unit shown in FIGS. 5-8, the housing 120*c* of the third cutting unit 110*c* is pivotally mounted to both the housing 120*a* of the first cutting unit 110*a* and the housing 120*b* of the second cutting unit 110*b*. Thus, the third primary pivot axis 102, about which the third cutting unit 110*c* is pivotal relative to the central support member 150, is a pivot axis about which the third cutting unit 110*c* is pivotal relative to both the central support member 150 and the first and second cutting units 110*a*, 110*b*. The third primary pivot axis 102 is realized by means of a first hinge structure, by means of which the housing 120*c* of the third cutting unit 110*c* is connected to the housing 120*a* of the first cutting unit 110*a*, and by means of a second hinge structure, by means of which the housing 120*c* of the third cutting unit 110*c* is connected to the housing 120*b* of the second cutting unit 110*b*. As shown in detail in FIG. 8, said first hinge structure comprises a bearing pin 126*a*, mounted in a fixed position to the housing 120*a* of the first cutting unit 110*a*, and a bearing bush 127*a* mounted in a fixed position to the housing 120*c* of the third cutting unit 110*c*. Likewise, said second hinge structure comprises a bearing pin 126*b*, mounted in a fixed position to the housing 120*b* of the second cutting unit 110*b*, and a bearing bush 127*b* mounted in a fixed position to the housing 120*c* of the third cutting unit 110*c*. The bearing pins 126*a*, 126*b* engage and are received by, respectively, the bearing bushes 127*a*, 127*b*. The bearing bushes 127*a*, 127*b* are coaxially arranged on the housing 120*c* of the third cutting unit 110*c* and, thereby, define the position of the third primary pivot axis 102 relative to the housing 120*c* of the third cutting unit 110*c*. As shown in FIG. 8, seen in a longitudinal sectional view along the third primary pivot axis 102, the bearing bushes 127*a*, 127*b* each have a non-cylindrical, in particular a convex internal bearing surface which is in contact with the associated bearing pin 126*a*, 126. In other words, the internal bearing surfaces of the bearing bushes 127*a*, 127*b* have a beveled shape towards both their ends, i.e. said internal bearing surfaces have a shape like an hour glass. As a result, the bearing pin 126*a* and the bearing bush 127*a* of the first hinge structure can mutually rotate about an axis parallel to the first primary pivot axis 1*a*. Likewise, the bearing pin 126*b* and the bearing bush 127*b* of the second hinge structure can mutually rotate about an axis parallel to the second primary pivot axis 1*b*. As a result, the first and second hinge structures are adapted to independently follow both a pivotal movement of the housing 120*a* of the first cutting unit 110*a* about the first primary pivot axis 101*a* and a pivotal movement of the housing 120*b* of the second cutting unit 110*b* about the second primary pivot axis 101*b*. Thus, the third cutting unit 110*c* is free to pivot about the third primary pivot axis 102 in any pivotal position of the first and second cutting units 110*a*, 110*b* about the first and second primary pivot axes 101*a*, 101*b*.

Figure 5:
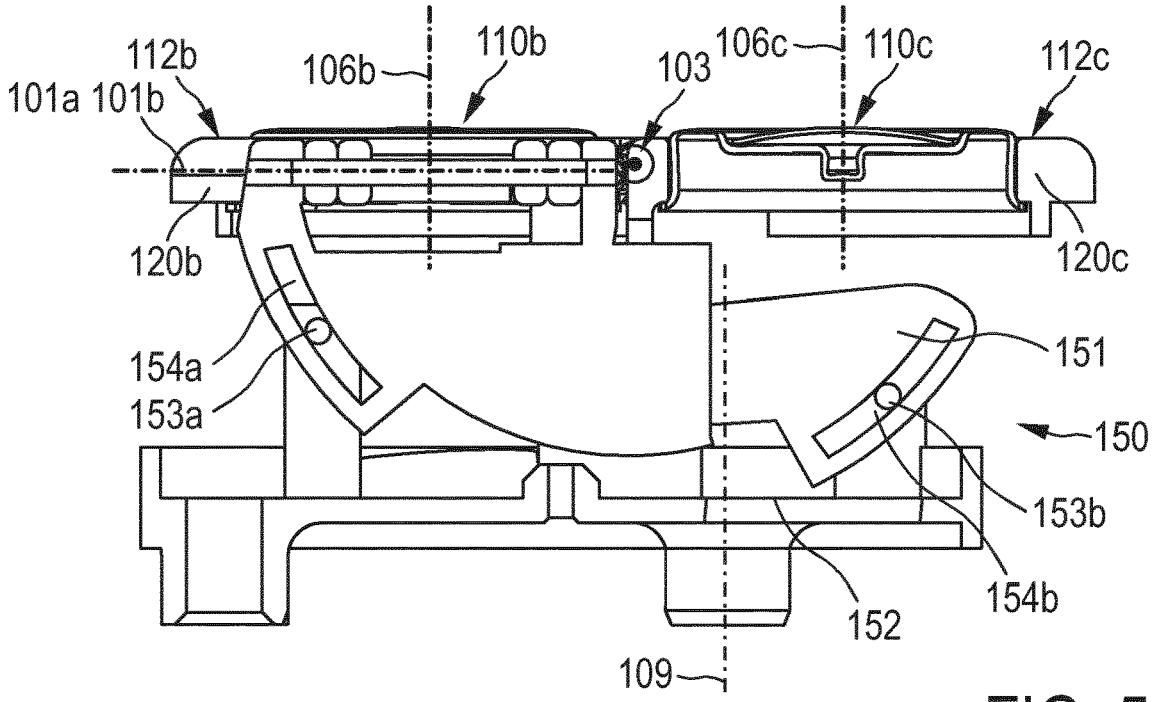
FIG. 5 shows a partially sectioned frontal view of parts of a shaving unit according to a second embodiment of the invention.

As shown in FIGS. 5 and 8, the central support member 150 is arranged below the cutting units 110*a*, 110*b*, 110*c* and comprises the moveable portion 151 and a stationary portion 152. The stationary portion 152 comprises a coupling member 170 by means of which the shaving unit can be releasably coupled to a main housing of a shaving apparatus. The movable portion 151 is pivotal relative to the stationary portion 152 about a secondary pivot axis 103, which extends perpendicularly to the coinciding first and second primary pivot axes 101*a*, 101*b* and parallel to the third primary pivot axis 102, as shown in FIG. 6. The secondary pivot axis 103 is realized by means of a connecting-link-guidance mechanism comprising at least one connecting member guided along a corresponding curved guidance path. In the embodiment shown in FIGS. 5-8, the connecting-link-guidance mechanism comprises a plurality of connecting members in the form of connecting pins 153*a*, 153*b*, 153*c* mounted in fixed positions to the stationary portion 152 of the central support member 150. The connecting pins 153*a*, 153*b*, 153*c* are each guided in a respective curved guidance slot 154*a*, 154*b*, 154*c* provided in a fixed position in the movable section 151 of the central support member 150. The curved guidance slots 154*a*, 154*b*, 154*c* each have a similar radius and coinciding center axes, which form a virtual axis defining the secondary pivot axis 103. By means of said connecting-link-guidance mechanism, the movable portion 151 of the central support member 150, carrying the three cutting units 110*a*, 110*b*, 110*c*, is pivotal relative to the stationary portion 152 of the central support member 150 about the secondary pivot axis 103.

Furthermore, in the embodiment shown in FIGS. 5-8, the coinciding first and second primary pivot axes 101*a*, 101*b*, the third primary pivot axis 102 and the secondary pivot axis 103 each extend parallel to a common plane, in which the skin contact surfaces of the shaving tracks 161*a*, 161*b*, 161*c* of the cutting units 110*a*, 110*b*, 110*c* extend when the cutting units 110*a*, 110*b*, 110*c* are in intermediate pivotal positions, as shown in FIG. 7, wherein the skin contact surfaces of the shaving tracks 161*a*, 161*b*, 161*c* each extend perpendicularly to a central axis 109 of the shaving unit and wherein the axes of rotation 106*a*, 10*b*, 106*c* of the cutting units 110*a*, 110*b*, 110*c* are mutually parallel. As a result of the presence of the first and second primary pivot axes 101*a*, 101*b*, the third primary pivot axis 103, and the secondary pivot axis 103, a twofold pivotal motion is provided for each cutting unit 110*a*, 110*b*, 110*c*, wherein the three cutting units 110*a*, 110*b*, 110*c* can perform a common pivotal movement about the secondary pivot axis 103 and wherein each cutting unit 110*a*, 110*b*, 110*c* can further perform an individual and independent pivotal movement about, respectively, the first, second and third primary pivot axis 101*a*, 101*b*, 102.

Figure 9:
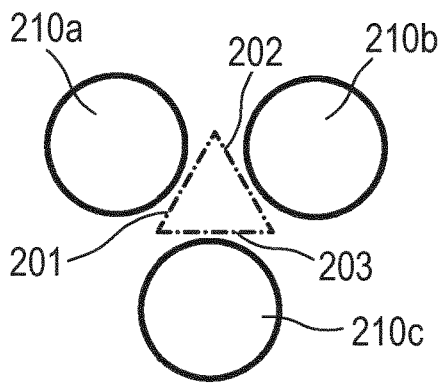
FIG. 9 shows a schematic top view of the arrangement of the primary pivot axes in a third embodiment of the shaving unit according to the invention.

FIG. 9 shows a schematic view of a third embodiment of a shaving unit according to the invention having three cutting units 210*a*, 210*b*, 210*c* and three primary pivot axes 201, 202, 203, i.e. a first primary pivot axis 201 for the first cutting unit 210*a*, a second primary pivot axis 202 for the second cutting unit 210*b* and a third primary pivot axis 203 for the third cutting unit 210*c*. Like the primary pivot axis 1*a*, 1*b*; 101*a*, 101*b*, 102 in the first and second embodiments, the primary pivot axes 201, 202, 203 each constitute a pivot axis about which the cutting units 210*a*, 210*b*, 210*c* are respectively pivotal relative to a central support member of the shaving unit, which is not shown in FIG. 9. In this embodiment, the three primary pivot axes 201, 202, 203 are arranged in a triangular configuration. The first primary pivot axis 201 is arranged between a shaving track (not shown) of the first cutting unit 210*a* and the axes of rotation of the internal cutting members (not shown) of the second and third cutting units 210*b*, 210*c*. Likewise, the second primary pivot axis 202 is arranged between a shaving track (not shown) of the second cutting unit 210*b* and the axes of rotation of the internal cutting members (not shown) of the first and third cutting units 210*a*, 210*c*, and the third primary pivot axis 203 is arranged between a shaving track (not shown) of the third cutting unit 210*c* and the axes of rotation of the internal cutting members (not shown) of the first and second cutting units 210*a*, 210*b*.

Figure 10:
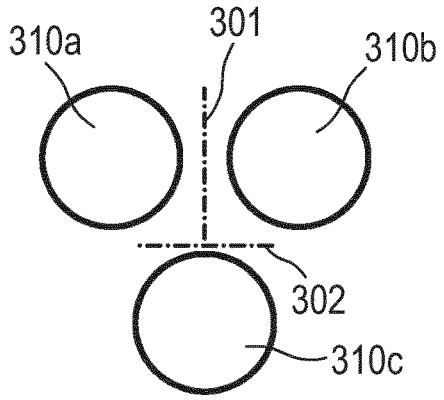
FIG. 10 shows a schematic top view of the arrangement of the primary pivot axes in a fourth embodiment of the shaving unit according to the invention.

FIG. 10 shows a schematic view of a fourth embodiment of a shaving unit according to the invention, having three cutting units 310*a*, 310*b*, 310*c* and having primary pivot axes 301 and 302. In this embodiment, the arrangement of the primary pivot axes 301, 302 is similar to the arrangement of the primary pivot axes 101*a*, 101*b*, 102 in the second embodiment explained beforehand. The first and second cutting units 310*a*, 310*b* have a common primary pivot axis 301, i.e. they have coinciding primary pivot axes about which the cutting units 310*a*, 310*b* can each individually and independently pivot relative to a central support member (not shown) of the shaving unit. The third cutting unit 310*c* has a primary pivot axis 302 about which the third cutting unit 310*c* can pivot relative to the central support member. The primary pivot axis 302 extends perpendicularly to the common primary pivot axis 301 of the first and second cutting units 310*a*, 310*b*. The common primary pivot axis 301 and the primary pivot axis 302 constitute, respectively, a leg and a crossbar of a T-shaped configuration of the primary pivot axes 301, 302.

Figure 11:
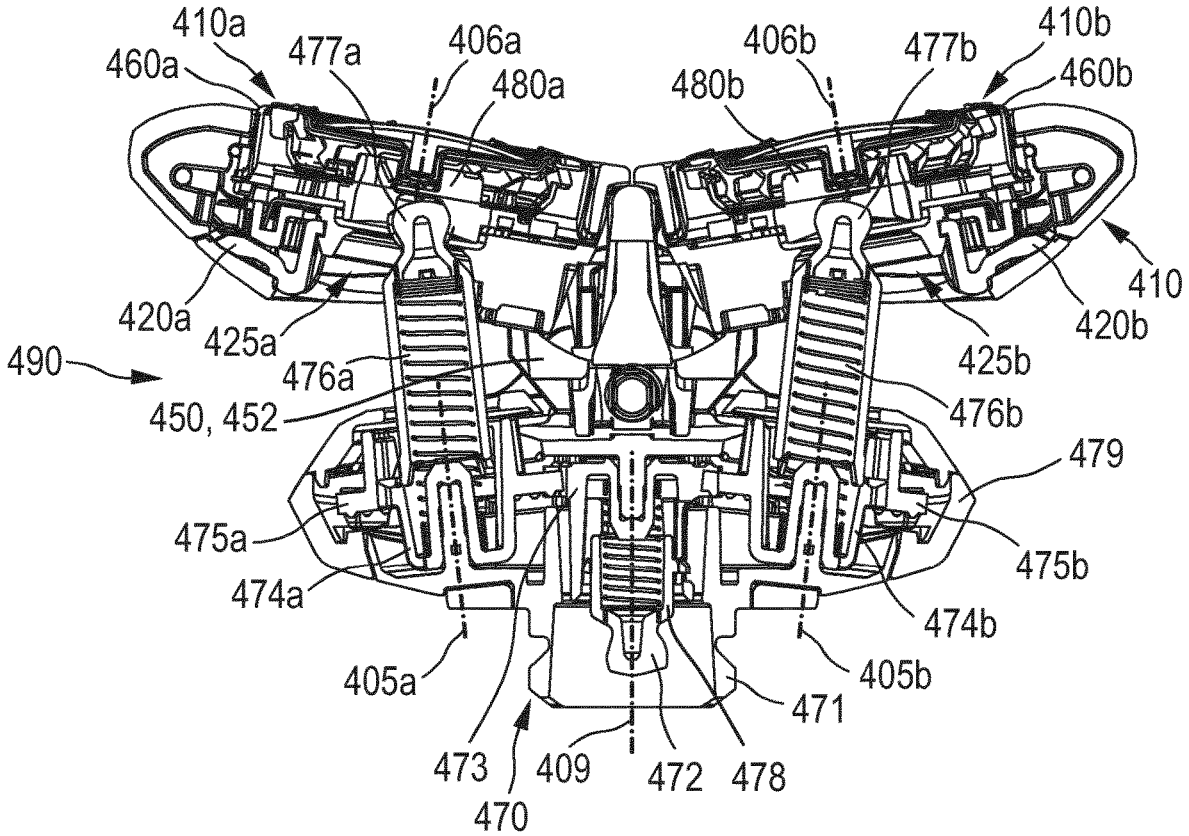
FIG. 11 shows a sectional frontal view of the shaving unit of FIGS. 1*a*-1*c*, depicting a drive train for the cutting units of the shaving unit.
Figure 12:
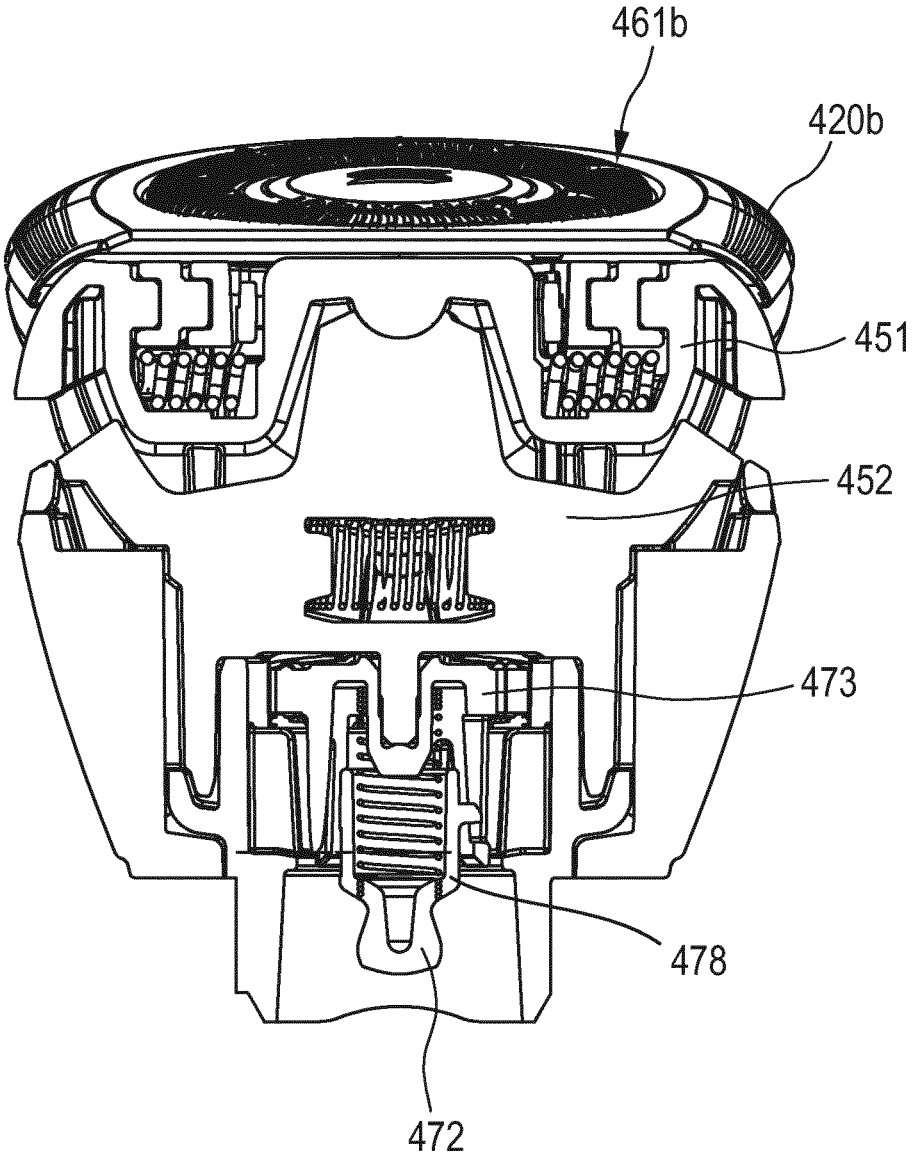
FIG. 12 shows a sectional side view of the shaving unit of FIG. 11.

FIG. 11 shows a sectional frontal view of the shaving unit of FIGS. 1-4 and shows a drive train for the first and second cutting units 410*a*, 410*b* of the shaving unit. The shaving unit as shown in FIG. 11 comprises a coupling member 470 at a bottom side of the shaving unit, by means of which the shaving unit can be releasably coupled to a main housing of a shaving apparatus. At its outer circumference the coupling member 470 comprises a stationary coupling component 471 for releasably mounting the shaving unit to the main housing, i.e. a handle section, of the shaving apparatus. Inside the coupling member 470, a rotatable coupling component 472 is accommodated. The rotatable coupling component 472 is mounted to an end portion of a central drive shaft 478 accommodated in the coupling member 470. The rotatable coupling component 472 is adapted to be coupled to a drive shaft of a drive unit incorporated in said handle section of the shaving apparatus for torque transmission from the drive shaft in the handle section to the central drive shaft 478, when the shaving unit is coupled to the handle section.

The rotatable coupling component 472 and the central drive shaft 478 are parts of the drive train of the shaving unit. The central drive shaft 478 is connected to a central transmission element, embodied as a central gear wheel 473. Said central gear wheel 473 is rotatable about a central transmission axis 409, which corresponds to the main drive axis 9 described beforehand with reference to the embodiment shown in FIGS. 1-4. During operation, with the shaving unit coupled to the handle section of the shaving apparatus, the central gear wheel 473 is driven into rotation about the central transmission axis 409 by the drive unit of the handle section via the rotatable coupling component 472 and the central drive shaft 478.

A first driven transmission element and a second driven transmission element, embodied as, respectively, a first driven gear wheel 475*a* and a second driven gear wheel 475*b*, are arranged to be driven by the central gear wheel 473. The first and second driven gear wheels 475*a*, 475*b* are positioned adjacent to and on opposite sides of the central gear wheel 473 and each engage the central gear wheel 473 for torque transmission. The first driven gear wheel 475*a* and the second driven gear wheel 475*b* are positioned, relative to the central transmission axis 409, radially outwardly from the central gear wheel 473, and are each arranged in a slightly oblique orientation with respect to the central transmission axis 409. Thus, the first driven gear wheel 475*a* is rotatable about a first transmission axis 405*a*, which has a slightly oblique orientation with respect to the central transmission axis 409. Likewise, the second driven gear wheel 475*b* is rotatable about a second transmission axis 405*b*, which also has a slightly oblique orientation with respect to the central transmission axis 409. The first and second transmission axes 405*a*, 405*b* are symmetrically arranged with respect to the central transmission axis 409.

The first and second transmission axes 405*a*, 405*b* and the central transmission axis 409 are each arranged in a stationary position relative to the coupling member 470 and relative to the stationary portion 452 of the central support member 450 of the shaving unit. The central gear wheel 473 and the first and second driven gear wheels 475*a*, 475*b* are accommodated in a transmission housing 479, which is also arranged in a stationary position relative to the coupling member 470 and relative to the stationary portion 452 of the central support member 450 of the shaving unit. The central gear wheel 473 and the first and second driven gear wheels 475*a*, 475*b* are arranged as a transmission unit, accommodated in the transmission housing 479, between the coupling member 470 and the first and second cutting units 410*a*, 410*b*. Between the transmission housing 479 and the first and second cutting units 410*a*, 410*b*, an open space 490 is present which surrounds the central support member 450 as shown in FIG. 11. The open space 490 between the transmission housing 479 and the first and second cutting units 410*a*, 410 is generally open and, thereby, accessible from any radial direction with respect to the central transmission axis 409. The transmission housing 479 is thus arranged between the coupling member 470 and the open space 490.

The internal cutting member 480*a* of the first cutting unit 410*a* is connected to the first driven gear wheel 475*a* by means of a first drive spindle 476*a*, and the internal cutting member 480*b* of the second cutting unit 410*b* is connected to the second driven gear wheel 475*b* by means of a second drive spindle 476*b*. The first drive spindle 476*a* extends from the transmission unit in the transmission housing 479 to the internal cutting member 480*a* of the first cutting unit 410*a* via the open space 490 and through the opening 425*a* in the bottom wall of the housing 420*a* of the first cutting unit 410*a*. Likewise, the second drive spindle 476*b* extends from the transmission unit in the transmission housing 479 to the internal cutting member 480*b* of the second cutting unit 410*b* via the open space 490 and through the opening 425*b* in the bottom wall of the housing 420*b* of the second cutting unit 410. The openings 425*a*, 425*b* in the bottom walls of the housings 420*a*, 420*b* of the first and second cutting units 410*a*, 410*b* shown in FIG. 11 correspond to the openings 25*a*, 25*b* in the bottom walls of the housings 20*a*, 20*b* of the first and second cutting units shown in FIG. 4.

The first and second driven gear wheels 475*a*, 475*b* are circumferentially provided and integrally formed on, respectively, a first cup-shaped rotatable carrier 474*a* and a second cup-shaped rotatable carrier 474*b*. A lower end portion of the first drive spindle 476*a* engages the first rotatable carrier 474*a*, and a lower end portion of the second drive spindle 476*b* engages the second rotatable carrier 474*b*. The lower end portions of the first and second drive spindles 476*a*, 476*b* are configured in such a manner that the drive spindles 476*a*, 476*b* can slide in the two opposite directions parallel to, respectively, the first transmission axis 405*a* and the second transmission axes 405*b* inside, respectively, the first cup-shaped rotatable carrier 474*a* and the second cup-shaped rotatable carrier 474*b*. A mechanical spring is arranged in each of the first and second drive spindles 476*a*, 476*b*, as shown in FIG. 11. The first drive spindle 476*a* is displaceable towards the first driven gear wheel 475*a* against a spring force of the associated mechanical spring in a direction parallel to a spindle axis of the first drive spindle 476*a*, which generally extends substantially or nearly parallel to the first transmission axis 405*a*. Likewise, the second drive spindle 476*b* is displaceable towards the second driven gear wheel 475*b* against a spring force of the associated mechanical spring in a direction parallel to a spindle axis of the second drive spindle 476*b*, which generally extends substantially or nearly parallel to the second transmission axis 405*b*.

Furthermore, the lower end portions of the first and second drive spindles 476*a*, 476*b* are configured in such a manner that the drive spindles 476*a*, 476*b* can pivot relative to, respectively, the first driven gear wheel 475*a* and the second driven gear wheel 475*b* to a limited extent about any axis perpendicular to, respectively, the first transmission axis 405*a* and the second transmission axes 405*b*. Finally, the lower end portions of the first and second drive spindles 476*a*, 476*b* are configured in such a manner that the first and second cup-shaped rotatable carriers 474*a*, 474*b* can transmit a driving torque to, respectively, the first drive spindle 476*a* and the second spindle 476*b* by engagement with the lower end portions thereof.

As further shown in FIG. 11, coupling elements 477*a*, 477*b* are provided on an upper end portion of, respectively, the first drive spindle 476*a* and the second drive spindle 476*b*. The coupling elements 477*a*, 477*b* couple the first and second drive spindles 476*a*, 476*b* with, respectively, the internal cutting member 480*a* of the first cutting unit 410*a* and the internal cutting member 480*b* of the second cutting unit 410*b*. The coupling elements 477*a*, 477*b* are configured in such a manner that the first and second drive spindles 476*a*, 476*b* can transmit a driving torque to, respectively, the internal cutting member 480*a* of the first cutting unit 410*a* and the internal cutting member 480*b* of the second cutting unit 410*b*. Thus, the first and second drive spindles 476*a*, 476*b* are able to transmit a rotational movement from the first and second driven gear wheels 475*a*, 475*b* via the coupling elements 477*a*, 477*b* to the internal cutting members 480*a*, 480*b* of the first and second cutting units 410*a*, 410*b*, respectively. Furthermore, the coupling elements 477*a*, 477*b* are configured in such a manner that the first and second drive spindles 476*a*, 476*b* can pivot to a limited extent relative to, respectively, the internal cutting member 480*a* of the first cutting unit 410*a* and the internal cutting member 480*b* of the second cutting unit 410*b* about any axis perpendicular to, respectively, the first transmission axis 405*a* and the second transmission axes 405*b*. This can e.g. be achieved by a triangular cross-sectional geometry of the coupling elements 477*a*, 477*b* and by providing each internal cutting member 480*a*, 480*b* with a coupling cavity having a corresponding geometry for receiving the associated coupling element 477*a*, 477*b*, as is well known to the person skilled in the art. It is to be understood that the coupling elements 477*a*, 477*b* correspond with the coupling elements 41*a*, 41*b* of the shaving unit shown in FIG. 4.

During operation, the internal cutting members 480*a*, 480*b* of the first and second cutting units 410*a*, 410*b* are driven into a rotational movement about the first and second axes of rotation 406*a*, 406*b* relative to the external cutting members 460*a*, 460*b* of the first and second cutting units 410*a*, 410*b* by the first and second drive spindles 476*a*, 476*b*, respectively. As described here before, the first and second drive spindles 476*a*, 476*b* are displaceable against a spring force in directions parallel to their spindle axes relative to, respectively, the first and second driven gear wheels 475*a*, 475*b*. Furthermore, as described here before, the first and second drive spindles 476*a*, 476*b* are pivotally arranged relative to, respectively, the first and second driven gear wheels 475*a*, 475*b* and relative to the internal cutting member 480*a*, 480*b* of, respectively, the first and second cutting units 410*a*. As a result, the first and second drive spindles 476*a*, 476*b* can follow pivotal movements of the first and second cutting units 410*a*, 410*b* about their primary pivot axis 1*a*, 1*b* as described with respect to the embodiment of the shaving unit of FIGS. 1-4. The mechanical springs arranged in the drive spindles 476*a*, 476*b* bias the drive spindles 476*a*, 476*b* towards the internal cutting members 480*a*, 480*b* and thus maintain a permanent contact and engagement between the coupling elements 477*a*, 477*b* and the internal cutting members 480*a*, 480*b* in any pivotal position of the first and second cutting units 410*a*, 410*b* about the primary pivot axes 1*a*, 1*b* and in any angular orientation of the first and second axis of rotation 406*a*, 406*b* relative to, respectively, the first and second transmission axis 405*a*, 405*b*.

In the embodiment of the shaving unit shown in FIGS. 1-4 and in FIG. 11, the spindle axes of the first and second drive spindles 476*a*, 476*b* and the secondary pivot axis 3 extend in a common imaginary plane, as can best be seen in FIG. 4. As a result, during pivotal movements of the first and second cutting units 410*a*, 410*b* about the secondary pivot axis 3, the drive spindles 476*a*, 476*b* will remain in said common imaginary plane and their positions in said common imaginary plane do not substantially change. This will particularly be the case when the secondary pivot axis 3 extends through the coupling elements 477*a*, 477*b* of the drive spindles 476*a*, 476*b*. In alternative embodiments wherein the spindle axes of the first and second drive spindles 476*a*, 476*b* and the secondary pivot axis 3 do not extend in a common imaginary plane, the layout of the drive spindles 476*a*, 476*b* and the coupling elements 477*a*, 477*b* as described here before will allow the drive spindles 476*a*, 476*b* to also follow pivotal movements of the first and second cutting units 410*a*, 410*b* about the secondary pivot axis 3 as described with respect to the embodiment of the shaving unit of FIGS. 1-4, as well as combined pivotal movements of the first and second cutting units 410*a*, 410*b* about both their primary pivot axes 1*a*, 1*b* and the secondary pivot axis 3.

It is to be understood that, in embodiments of a shaving unit comprising three cutting units as e.g. shown in FIGS. 5-8, the internal cutting member of the third cutting unit may be connected to the transmission unit by means of a third drive spindle extending from the transmission unit to said internal cutting member via the open space and through an opening in a bottom wall of the housing of the third cutting unit. In such embodiments, the third drive spindle may have a similar layout as the first and second drive spindles 476*a*, 476*b* in the embodiment of the shaving unit shown in FIG. 11. It will be clear that, in such embodiments, the transmission unit may comprise a third driven transmission element, e.g. a third driven gear wheel, arranged to be driven by the central gear wheel of the transmission unit in a manner similar to the first and second driven gear wheels 475*a*, 475*b* in the embodiment of the shaving unit shown in FIG. 11. In such embodiments, the internal cutting member of the third cutting unit is connected to said third driven gear wheel via the third drive spindle.

Figure 13:
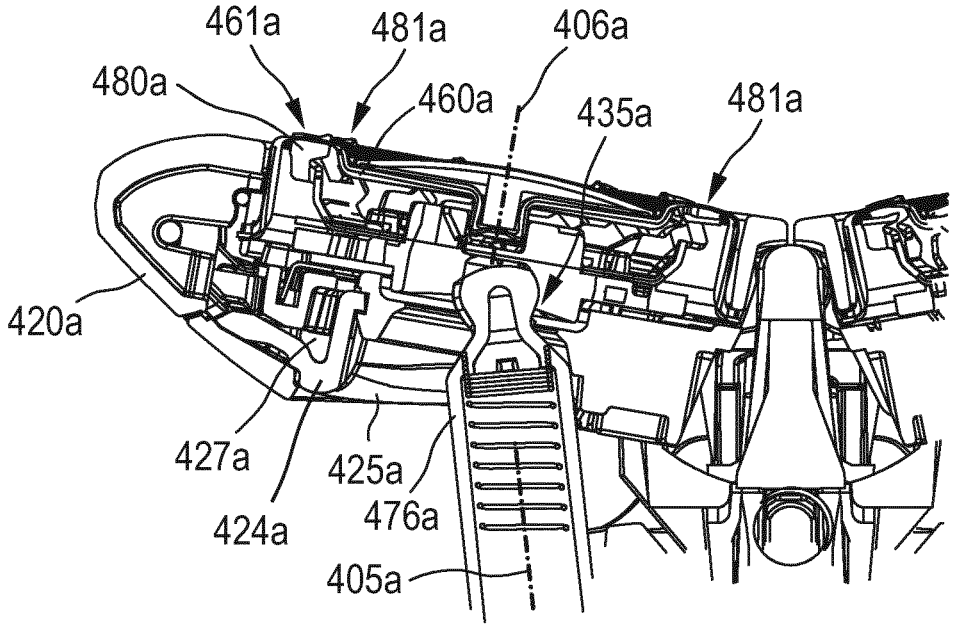
FIG. 13 shows a detailed view of a cutting unit and part of the drive train in the shaving unit of FIG. 11.
Figure 14:
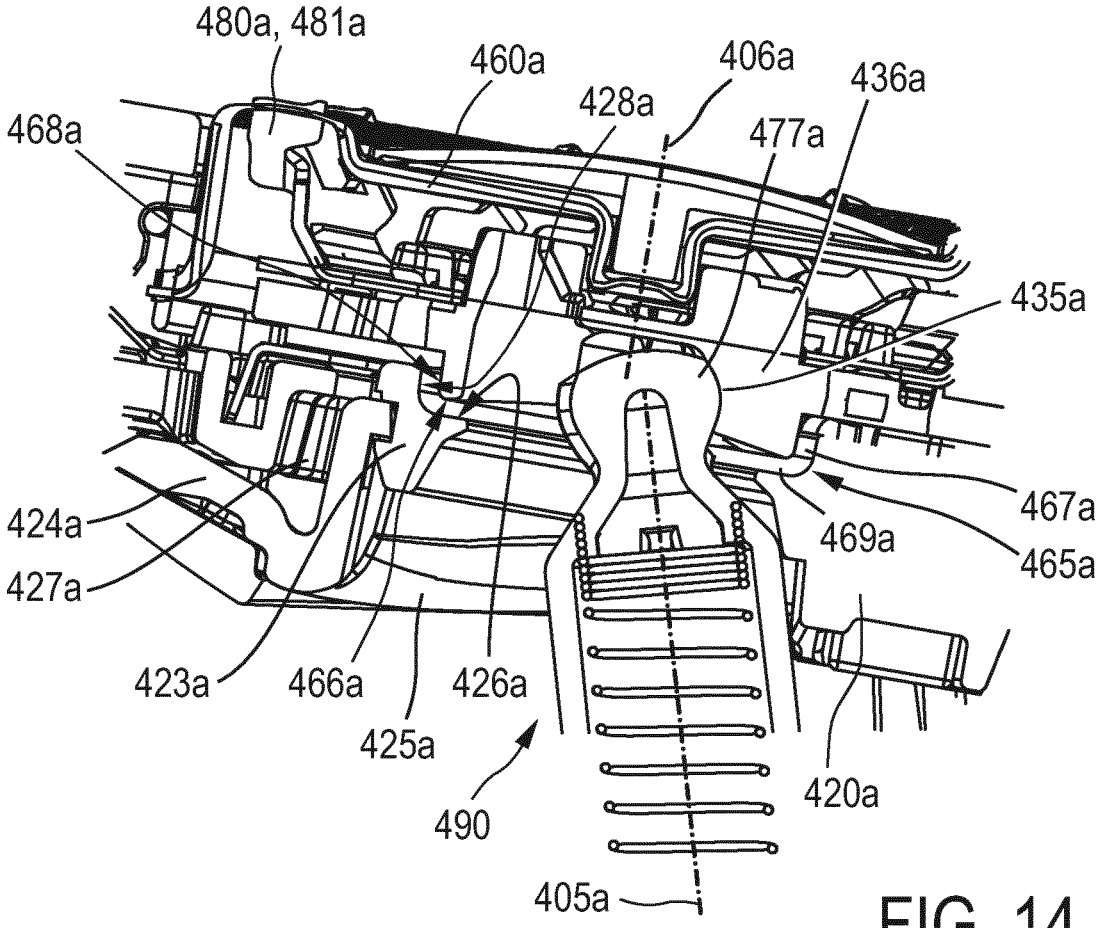
FIG. 14 shows a further detailed view of the shaving unit as shown in FIG. 13.

FIGS. 13 and 14 are detailed views of the first cutting unit 410*a* of the shaving unit of FIG. 11. In the following, further structural elements of the first cutting unit 410*a* of the shaving unit of FIG. 11 will be described with reference to FIGS. 13 and 14. It is to be understood that the second cutting unit 410*b* of the shaving unit of FIG. 11 has similar structural elements. It is further to be understood that also the cutting units of the embodiment of the shaving unit shown in FIGS. 5-10 may have similar structural elements.

FIGS. 13 and 14 show the internal cutting member 480*a* in a position in the housing 420*a* below the external cutting member 460*a*. The external cutting member 460*a* has a plurality of hair entry openings which define the shaving track 461*a* along which, during operation, hair-cutting actions will take place by interaction between the external cutting member 460*a* and the internal cutting member 480*a* rotating relative to the external cutting member 460*a* about the axis of rotation 406*a*. Any cut hairs will be received by and collected in the hair collecting chamber 427*a* which is accommodated in the housing 420*a*. FIGS. 13 and 14 further show in detail the first drive spindle 476*a* which extends through the opening 425*a* provided in the bottom wall 424*a* of the housing 420*a*. The opening 425*a* is provided centrally around the axis of rotation 406*a*. The hair collecting chamber 427*a* is annularly arranged around the opening 425*a* and around the axis of rotation 406*a*. The coupling element 477*a* of the first drive spindle 476*a* engages a coupling cavity 435*a*, which is centrally provided in a central carrying member 436*a* of the internal cutting member 480*a*. The central carrying member 436*a* carries a plurality of cutting elements 481*a* of the internal cutting member 480*a*.

The opening 425*a* is in fluid communication with the hair collecting chamber 427*a*. As a result, the hair collecting chamber 427*a* can be cleaned by providing a flow of a cleaning liquid, e.g. water, via the opening 425*a* into the hair collecting chamber 427*a*. Such a flow of e.g. water can be easily provided to the opening 425*a* via the open space 490 which is present between the transmission housing 479 and the cutting units 410*a*, 410*b*. To prevent cut hairs and other shaving debris from escaping from the hair collecting chamber 427*a* via the opening 425*a* into the open space 490 during normal use of the shaving unit, a sealing structure 465*a* is provided in the flow path between the opening 425*a* and the hair collecting chamber 427*a*. The sealing structure 465*a* is configured and arranged to prevent cut hairs from escaping from the hair collecting chamber 427*a* via the opening 425*a*, but to allow a cleaning liquid, in particular water, to flow or flush via the opening 425*a* into the hair collecting chamber 427*a*. An embodiment of the sealing structure 465*a* will be described in the following. It is to be understood that the second cutting unit 410*b* has a similar sealing structure.

As shown in detail in FIG. 14, the sealing structure 465*a* comprises opposed sealing surfaces 426*a*, 428*a* and 466*a*, 468*a*. The sealing surfaces 426*a*, 428*a* are provided on the housing 420*a*, in particular on an edge structure 423*a* which is provided in the bottom wall 424*a* around the opening 425*a*. The sealing surfaces 466*a*, 468*a* are provided on the internal cutting member 480*a*, in particular on the central carrying member 436*a* of the internal cutting member 480*a*. The opposed sealing surfaces 426*a*, 428*a* and 466*a*, 468*a* are rotationally symmetrical relative to the axis of rotation 406*a*. As a result, the sealing structure 465*a* is rotationally symmetrical relative to the axis of rotation 406*a*.

In particular, the sealing structure 465*a* comprises a first sealing gap 467*a*, which is rotationally symmetrical relative to the axis of rotation 406*a* and has a main direction of extension parallel to the axis of rotation 406*a*. The first sealing gap 467*a* is bounded by a first sealing surface 468*a* of said opposed sealing surfaces, which is provided on the central carrying member 436*a* of the internal cutting member 480*a*, and by a second sealing surface 428*a* of said opposed sealing surfaces, which is provided on the edge structure 423*a* in the bottom wall 424*a* of the housing 420*a*. The first and second sealing surfaces 468*a*, 428*a* are each rotationally symmetrical relative to the axis of rotation 406*a* and each have a main direction of extension parallel to the axis of rotation 406*a*. In particular, the first and second sealing surfaces 468*a*, 428*a* and the first sealing gap 467*a*, bounded by the first and second sealing surfaces 468*a*, 428*a*, are each annular.

Further, the sealing structure 465*a* comprises a second sealing gap 469*a*, which is rotationally symmetrical relative to the axis of rotation 406*a* and has a main direction of extension perpendicular to the axis of rotation 406*a*. The second sealing gap 469*a* is bounded by a third sealing surface 466*a* of said opposed sealing surfaces, which is provided on the central carrying member 436*a* of the internal cutting member 480*a*, and by a fourth sealing surface 426*a* of said opposed sealing surfaces, which is provided on the edge structure 423*a* in the bottom wall 424*a* of the housing 420*a*. The third and fourth sealing surfaces 466*a*, 426*a* are each rotationally symmetrical relative to the axis of rotation 406*a* and each have a main direction of extension perpendicular to the axis of rotation 406*a*. In particular, the third and fourth sealing surfaces 466*a*, 426*a* and the second sealing gap 469*a*, bounded by the third and fourth sealing surfaces 466*a*, 426*a*, are each annular.

Seen in a cross-sectional view along the axis of rotation 406*a*, the axially oriented first sealing gap 467*a* and the radially oriented second sealing gap 469*a* together provide the sealing structure 465*a* with an L-shaped gap structure provided between the edge structure 423*a* and the central carrying member 436*a*, which is rotatable relative to the edge structure 423*a* about the axis of rotation 406*a*. In order to achieve an effective preventing of cut hairs from escaping from the hair collecting chamber 427*a* via the sealing structure 465*a* during a shaving procedure, while allowing an effective flow of water from the opening 425*a* via the sealing structure 465*a* into the hair collecting chamber 427*a*, a minimum distance between the first sealing surface 468*a* and the second sealing surface 428*a*, measured in a direction perpendicular to the axis of rotation 406*a*, is preferably in a range between 0.1 mm and 1.5 mm. For similar reasons, a minimum distance between the third sealing surface 466*a* and the fourth sealing surface 426*a*, measured in a direction parallel to the axis of rotation 406*a*, is preferably in a range between 0.1 mm and 1.5 mm. To further improve the sealing function of the sealing structure 465*a*, the first and second sealing gaps 467*a*, 469*a* may each converge, seen in a direction of the water flow from the central opening 425*a* to the hair collecting chamber 427*a*.

Figure 15:
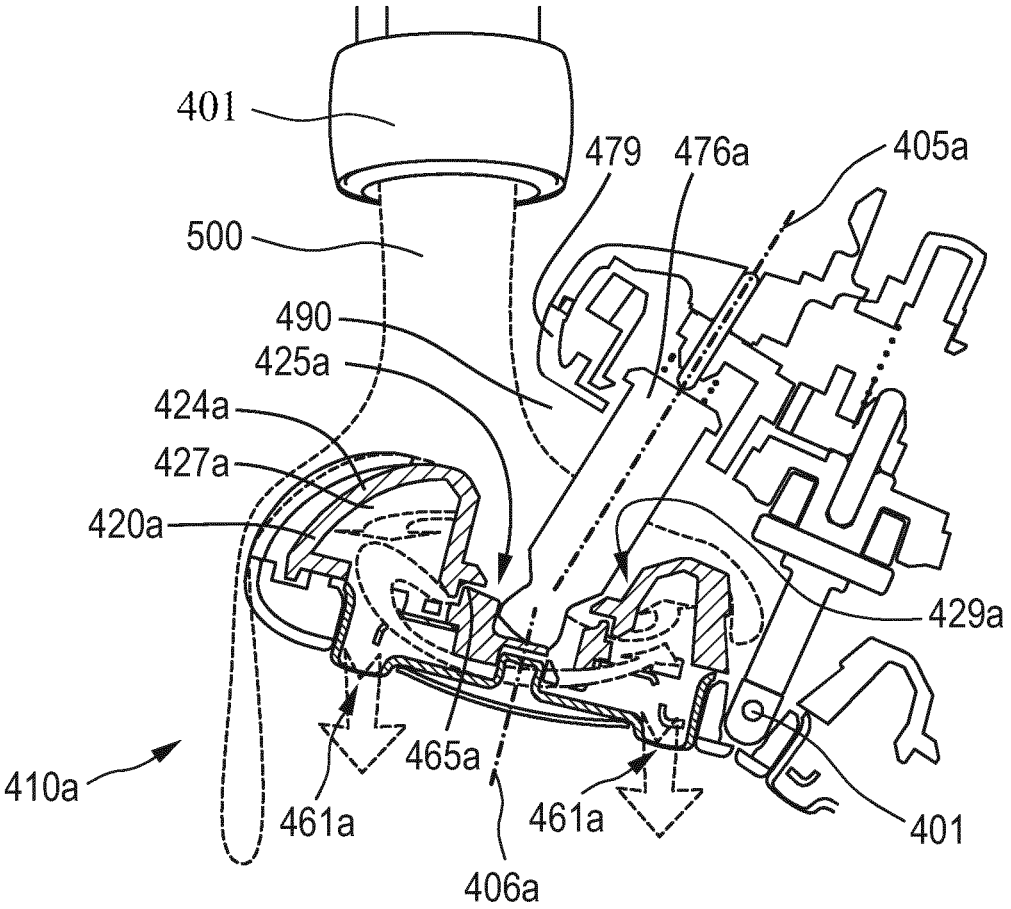
FIG. 15 shows a partial cross-sectional view of a detail of the shaving unit as shown in FIGS. 13 and 14 illustrating a flushing procedure of a cutting unit of the shaving unit.

FIG. 15 shows a flushing procedure to clean the hair collecting chamber 427*a* of the first cutting unit 410*a*. In FIG. 15 the shaving unit is shown in an upside-down position to facilitate a flow of water via the open space 490 into the opening 425*a* in the bottom wall 424*a* of the housing 420*a*. As illustrated in FIG. 15, in said upside-down position of the shaving unit the open space 490 allows a flow of water 500, e.g. from a water tap 401, to directly enter the cutting unit 410*a* via the opening 425*a*. This can be simply realized by directing a stream of water 500 from the tap 401 via the open space 490 onto the bottom wall 424*a* of the cutting unit 410*a*. The flushing water is directed into the opening 425*a* by a funnel 429*a*, provided in the bottom wall 424*a* of the housing 420*a*, and passes into the hair collecting chamber 427*a* via the L-shaped sealing structure 465*a*, which is provided in the flow path between the opening 425*a* and the hair collecting chamber 427*a*. As indicated in FIG. 15 by broken arrows which show the flow of water through the cutting unit 410*a*, the hair collecting chamber 427*a* is flushed by the flow of water. Under the influence of both the gravity force and the hydraulic pressure of the flow of water, the flow of water is forced to leave the hair collecting chamber 427*a* via the plurality of hair entry openings provided in the shaving track 461*a* of the external cutting member 460*a*. This is indicated by two broken arrows pointing in downward direction in FIG. 15. The flow of water will take up and carry cut hairs and other shaving debris collected in the collecting chamber 427*a*. As a result, the cut hairs and other shaving debris are removed from the hair collecting chamber 427*a* by the flow of water leaving the hair collecting chamber 427*a* via the hair entry openings in the shaving track 461*a*. Thus, the hair collecting chamber 427*a* can be cleaned in a simple and efficient way by flushing the cutting unit 410*a* by means of a flow of water supplied via the open space 490 and via the opening 425*a* into the hair collecting chamber 427*a*. It is clear for the skilled person that the second cutting unit 410*b* can be cleaned in a similar way, preferably together with the first cutting unit 410*a*.

FIGS. 16, 17 and 18*a*-18*b* are detailed views of the first cutting unit 410*a* of the shaving unit of FIG. 11. In the following, further structural elements of the first cutting unit 410*a* of the shaving unit of FIG. 11 will be described with reference to FIGS. 16, 17 and 18*a*-18*b*. It is to be understood that the second cutting unit 410*b* of the shaving unit of FIG. 11 has similar structural elements. It is further to be understood that also the cutting units of the embodiment of the shaving unit shown in FIGS. 5-10 may have similar structural elements.

Figure 18A:
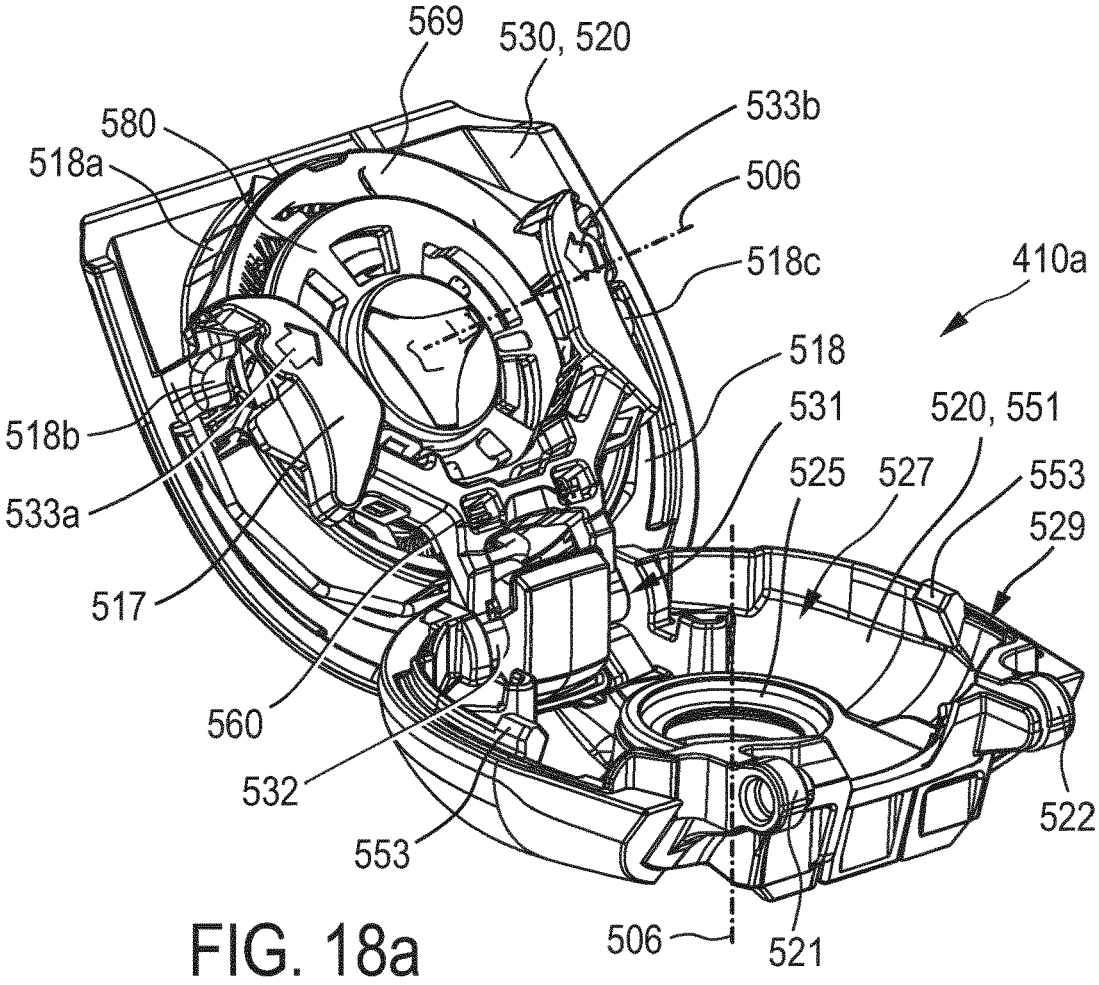
FIGS. 18*a* and 18*b* show a perspective view from an upper frontal side of a housing of the shaving unit of FIG. 11.

As shown in FIG. 18*a*, the housing 520 of the first cutting unit 410*a* comprises a base portion 551 and a cover portion 530. The cover portion 530 is releasably coupled to the base portion 551. In the embodiment shown in FIG. 18*a*, the cover portion 530 is pivotally coupled to the base portion 551 by means of a first hinge mechanism 531. By pivoting the cover portion 530 relative to the base portion 551, the housing 520 can be brought from an opened condition, as shown in FIG. 18*a*, to a closed condition, as e.g. shown in FIG. 11. In the closed condition of the housing 520, the cover portion 530 rests on a circumferential rim portion 529 of the base portion 551 and is releasably coupled to the base portion 551. For this purpose, the housing 520 may comprise any suitable releasable coupling mechanism, such as e.g. snapping elements 553 as shown in FIG. 18*a*. In the closed condition of the housing 520, the hair collecting chamber 527 provided in the base portion 551 is closed and not accessible for a user. In the opened condition of the housing 520, the cover portion 530 is released from the snapping elements 553 and, thereby, released and removed from the base portion 551, except for the permanent connection with the base portion 551 via the first hinge mechanism 531. In the opened condition of the housing 520, the hair collecting chamber 527 is accessible for the user. In alternative embodiments, the cover portion 530 may be completely removable from the base portion 551. In such alternative embodiments, a hinge mechanism connecting the cover portion 530 to the base portion 551 may not be present.

Figure 16:
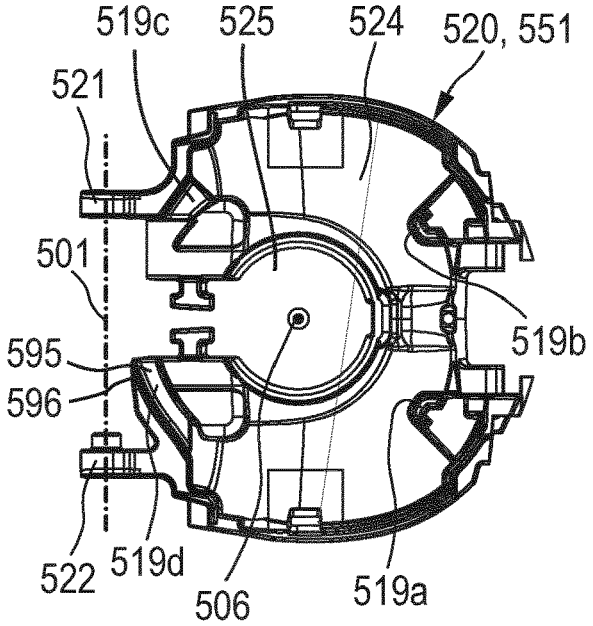
FIG. 16 shows a top view onto a part of a housing of a cutting unit incorporated in the shaving unit of FIG. 11.

FIG. 16 shows a top view onto the base portion 551 of the housing 520. As shown in FIGS. 16 and 18*a*, first and second hinge elements 521, 522 are integrally formed on the base portion 551. The first and second hinge elements 521, 522 correspond with, respectively, the first hinge element 21*a* and the third hinge element 22*a* of the first cutting unit 21*a* in the shaving unit as shown in FIG. 4. The first and second hinge elements 521, 522 define the primary pivot axis 501 about which the cutting unit is pivotal relative to the central support member of the shaving unit. The base portion 551 is thus connected to the central support member of the shaving unit by means of a pivot structure comprising the first and second hinge elements 521, 522. FIGS. 16 and 18*a* further show that the base portion 551 comprises the bottom wall 524 of the housing 520, and that the opening 525 is provided in the bottom wall 524 in a central position around the axis of rotation 506.

Figure 18B:
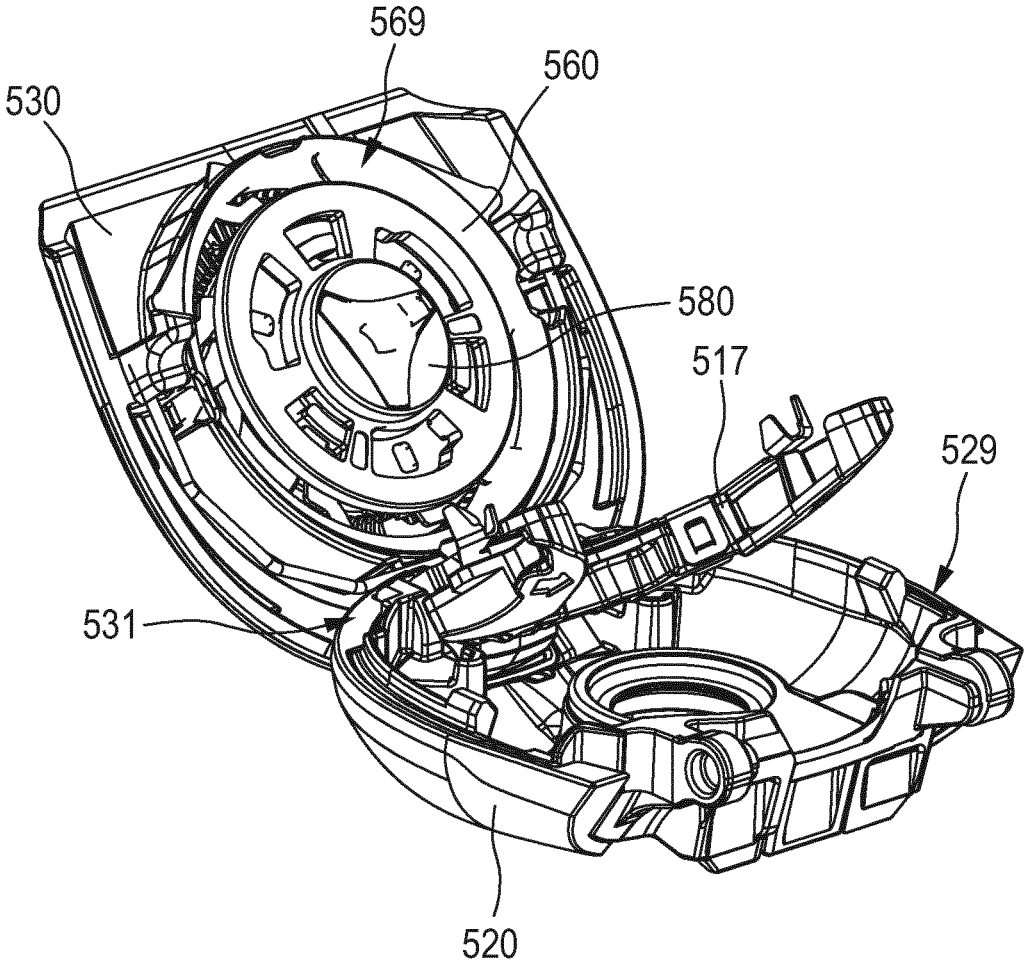

As further shown in FIGS. 18*a* and 18*b*, the cutting unit comprises a holding component 517 which is releasbly coupled to the cover portion 530 of the housing 520. In the embodiment shown in FIGS. 18*a* and 18*b*, the holding component 517 is pivotally coupled to the cover portion 530 by means of a second hinge mechanism 532. The first and second hinge mechanisms 531, 532 may be integrally formed. However, in any embodiments of the first and second hinge mechanisms 531, 532 the holding component 517 should be pivotal relative to the cover portion 530 by means of the second hinge mechanism 532 independently of a pivotal motion of the cover portion 530 relative to the base portion 551 by means of the first hinge mechanism 531. In its position shown in FIG. 18*a*, the holding component 517 is coupled to an inner side of the cover portion 530 by means of a releasable coupling mechanism 533*a*, 533*b*, which may be embodied as a simple snapping mechanism. In this position, the holding component 517 serves to hold the external cutting member 560 and the internal cutting member 580 in an operating position in the cover portion 530. In said operating position, the external cutting member 560 is held in the cover portion 530 by engagement of a circumferential rim 569, provided on a lower side of the external cutting member 560 facing towards the hair collecting chamber 527, with suitable positioning elements (not shown) provided on the inner side of the cover portion 530. The holding component 517 prevents the external cutting member 560 and the internal cutting member 580 from falling out of the cover portion 530 when the housing 520 is opened by pivoting the cover portion 530 relative to the base portion 551. By manually releasing the coupling mechanism 533*a*, 533*b* and pivoting the holding component 517 relative to the cover portion 530 into the position shown in FIG. 18*b*, the external cutting member 560 and the internal cutting member 580 can be simply removed from the cover portion 530, e.g. for cleaning the cutting members 560, 580 separately or for replacing the cutting members 560, 580 by new cutting members. In alternative embodiments, the holding component 517 may be completely removable from the cover portion 530. In such alternative embodiments, a hinge mechanism connecting the holding component 517 to the cover portion 517 may not be present.

As shown in FIG. 16, the base portion 551 of the housing 520 comprises a supporting structure 519*a*, 519*b*, 519*c*,

519*d* for supporting the external cutting member 560 in the closed condition of the housing 520. In the embodiment shown, the supporting structure 519*a*, 519*b*, 519*c*, 519*d* is provided on an inner side of the bottom wall 524 of the base portion 551, and the supporting structure 519*a*, 519*b*, 519*c*, 519*d* is arranged around the central opening 525 in a radial position, relative to the axis of rotation 506, outward of the central opening 525. In the embodiment shown, the supporting structure comprises four supporting elements 519*a*, 519*b*, 519*c*, 519*d* which are arranged with distances between each other around the axis of rotation 506. The supporting elements 519*a*, 519*b*, 519*c*, 519*d* each comprise an abutting surface 595, which extends substantially perpendicularly with respect to the axis of rotation 506 and, in the closed condition of the housing 520, faces towards the external cutting member 560. The abutting surfaces 595 of the supporting elements 519*a*, 519*b*, 519*c*, 519*d* extend in a common plane. In FIG. 16, the abutting surface of only the supporting element 519*b* is indicated by the reference number 595 for simplicity. Preferably, the supporting elements 519*a*, 519*b*, 519*c*, 519*d* are integrally formed at the base portion 551 of the housing 520, e.g. by means of an injection molding process, and preferably they are evenly distributed around the axis of rotation 506. In the embodiment shown, the four supporting elements 519*a*, 519*b*, 519*c*, 519*d* are arranged around the axis of rotation 506 with angular separations of approximately 90° between them. The abutting surfaces 595 of the four supporting elements 519*a*, 519*b*, 519*c*, 519*d* together form an abutment structure for the external cutting member 560 in the closed condition of the housing 520.

Starting from the opened condition of the housing 520 with the external cutting member 560 and the internal cutting member 580 being held in their operating positions in the cover portion 530 by the holding component 517 as shown in FIG. 18*a*, a user has to close the housing 520 by pivoting the cover portion 530 relative to the base portion 551 until the cover portion 530 is coupled to the base portion 551 by means of the snapping elements 553. When the housing 520 is closed in this way and the cover portion 530 is coupled to the base portion 551 by means of the snapping elements 553, the circumferential rim 569 of the external cutting member 560 will abut against the abutting surfaces 595 of the supporting elements 519*a*, 519*b*, 519*c*, 519*d* and will remain in abutting contact with the abutting surfaces 595. As a result, in the closed condition of the housing 520, the external cutting member 560 is directly supported by the abutting surfaces 595 of the supporting elements 519*a*, 519*b*, 519*c*, 519*d* in an axial direction parallel to the axis of rotation 506. As a result, pressure forces, which are exerted on the external cutting member 560 during use mainly in the axial direction parallel to the axis of rotation 506, will be mainly transferred by the external cutting member 560 directly to the supporting structure formed by the supporting elements 519*a*, 519*b*, 519*c*, 519*d* and, thereby, directly to the base portion 551 of the housing 520. As a result, the holding component 517 does not need to receive and transfer said pressure forces, or may need to receive and transfer only a minor portion of said pressure forces. For this reason, the holding component 517 and also the coupling mechanism 533*a*, 533*b*, by means of which is holding component 517 is releasably coupled to the cover portion 530, do not need to have a relatively rigid structure which would be required to receive and transfer said pressure forces. The holding component 517 should only be able to maintain the external cutting member 560 and the internal cutting member 580 in their operating positions in the cover portion 530 when the cover portion 530 is pivoted relative to the base portion 551 to open the housing 520. For this purpose, the holding component 517 and also the coupling mechanism 533*a*, 533*b* only need to have a relatively weak structure. Such a relatively weak structure enables an easy and simple manipulation by the user of the holding component 517 during cleaning or replacing the cutting members 560, 580.

Figure 17:
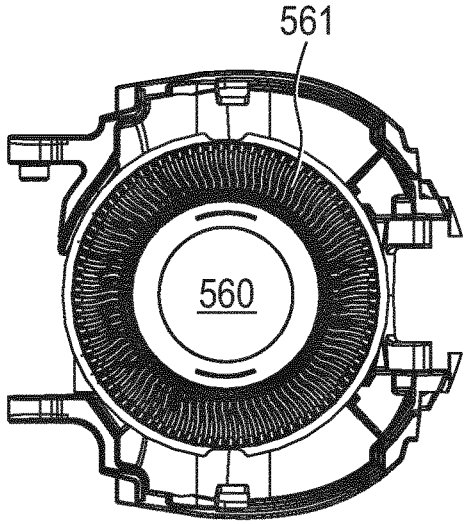
FIG. 17 shows a top view according to FIG. 16 with an external cutting member mounted into the housing.

In particular, in this embodiment the abutment structure formed by the abutting surfaces 595 of the supporting elements 519*a*, 519*b*, 519*c*, 519*d* provides, in the closed condition of the housing 520 and in said axial direction, a form-locking engagement with the external cutting member 560, wherein the external cutting member 560 is locked in the axial direction between the abutting surfaces 595 and the cover portion 530. Preferably, the abutment structure also provides a form-locking engagement with the external cutting member 560 in radial directions perpendicular to the axis of rotation 506. For this purpose, in the embodiment shown in FIG. 16, the supporting elements 519*a*, 519*b*, 519*c*, 519*d* each comprise a further abutting surface 596, which extends in a tangential direction with respect to the axis of rotation 506. In FIG. 16, the further abutting surface of only the supporting element 519*b* is indicated by the reference number 596 for simplicity. The further abutting surfaces 596 of the supporting elements 519*a*, 519*b*, 519*c*, 519*d* have equal distances to the axis of rotation 506. As a result, in the closed condition of the housing 520, the annular circumferential rim 569 of the external cutting member 560 is also held in a radially centered position relative to the axis of rotation 506 by the further abutting surfaces 596. FIG. 17 shows the shaving track 561 of the external cutting member 560 in a position supported by the supporting elements 519*a*, 519*b*, 519*c*, 519*d*, but does not show the cover portion 530.

It is to be understood that a direct support of the external cutting member 560 by the base portion 551 of the housing 520 in the axial direction parallel to the axis of rotation 506 may also be achieved by a supporting structure different from the supporting structure having the four supporting elements 519*a*, 519*b*, 519*c*, 519*d* as described here before. The supporting structure may have a different number of supporting elements, although in embodiments having a plurality of supporting elements at least three supporting elements are preferred for a stable support of the external cutting member. Instead of being provided on the bottom wall 524 of the base portion 551, the supporting structure may alternatively be provided on e.g. a side wall of the base portion 551, e.g. as a supporting surface extending circumferentially around the hair collecting chamber 527. A skilled person will be able to define suitable alternative embodiments wherein the supporting structure is provided in the base portion of the housing such as to support the external cutting member at least in the axial direction parallel to the axis of rotation in the closed condition of the housing of the cutting unit.

The invention further relates to a shaving apparatus comprising a main housing accommodating a motor and comprising a shaving unit as described here before. In particular, the shaving unit is or may be releasably coupled to the main housing by means of the coupling member 70, 170, 470. The main housing accommodating the motor and any further components of such a shaving apparatus, such as a rechargeable battery, user interface, and electrical control circuitry, are not shown in the figures and are not described in any further detail, as they are generally known to a person skilled in the art.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality.

Any reference signs in the claims should not be construed as limiting the scope.

The invention claimed is:

1. A shaving unit for a shaving apparatus, wherein the shaving unit comprises at least two cutting units, and wherein each cutting unit comprises:

an external cutting member having a plurality of hair entry openings;

an internal cutting member which is rotatable relative to the external cutting member about an axis of rotation; and a housing comprising a base portion and a cover portion which is releasably coupled to the base portion, wherein the base portion and/or the cover portion of the housing accommodate a hair collection chamber, wherein the external cutting member and the internal cutting member are held in an operating position in the cover portion by a holding component which is releasably coupled to the cover portion;

wherein the housing has a closed position where the cover portion holding the external cutting member and the internal cutting member via the holding component is coupled to the base portion and closes the hair collection chamber, and an opened position where the cover portion is at least partially released and at least partially removed from the base portion so that the hair collection chamber is accessible for a user, wherein the base portion of the housing of each cutting unit comprises a supporting structure, wherein, in the closed position of the housing, the external cutting member is directly supported by the supporting structure at least in an axial direction parallel to the axis of rotation.

2. The shaving unit according to claim 1, wherein the releasable coupling between the cover portion and the base portion includes a first pivoting hinge mechanism.

3. The shaving unit according to claim 2, wherein the releasable coupling between the holding component and the cover portion by includes a second pivoting hinge mechanism.

4. The shaving unit according to claim 1, wherein the supporting structure has an abutment structure that, in the closed position of the housing, locks the external cutting member in the axial direction between the abutment structure and the cover portion.

5. The shaving unit according to claim 4, wherein, in the closed position of the housing, the abutment structure locks the external cutting member in a radial direction perpendicular to the axis of rotation.

6. The shaving unit according to claim 4, wherein the abutment structure comprises at least one abutting surface extending substantially perpendicularly with respect to the axis of rotation and facing towards the external cutting member in the closed position of the housing.

7. The shaving unit according to claim 6, wherein the abutment structure comprises a plurality of abutting surfaces each extending substantially perpendicularly with respect to the axis of rotation and each facing towards the external cutting member in the closed position of the housing, and wherein the abutting surfaces are arranged with distances between each other around the axis of rotation.

8. The shaving unit according to claim 1, wherein the base portion comprises a bottom wall, and wherein the supporting structure is provided on an inner side of the bottom wall.

9. The shaving unit according to claim 8, wherein the bottom wall comprises a central opening and wherein the supporting structure is arranged around the central opening in a radial position, relative to the axis of rotation, outward of the central opening.

10. The shaving unit according to claim 1, wherein the cutting units are pivotally mounted to a central support member, such that the cutting units are each pivotable relative to the central support member about a pivot axis.

11. The shaving unit according to claim 10, wherein the pivot axis is provided by a pivot structure that connects the base portion to the central support member.

12. The shaving unit according to claim 10, wherein the central support member comprises a coupling member to releasably couple the shaving unit to a main housing of the shaving apparatus.

13. The shaving unit of claim 1, wherein the supporting structure of the base portion includes at least one surface that directly contacts a circumferential rim of the external cutting member in the closed position of the housing.

14. The shaving unit of claim 13, wherein the at least one surface is an integral part of the base portion of the housing.

15. The shaving unit of claim 1, wherein the supporting structure includes at least two surfaces that are separated from each other and directly contact the external cutting member in the closed position of the housing, and wherein the at least two surfaces extend in a common plane which extends in a tangential direction with respect to the axis of rotation.

16. A shaving apparatus comprising:

a main housing containing a motor; and a shaver having at least two cutters, wherein the shaver is coupled to the main housing, wherein each cutter of the at least two cutters includes:

an external cutting member having a plurality of hair entry openings;

an internal cutting member which is rotatable relative to the external cutting member about an axis of rotation; and a housing comprising a base portion and a cover portion which is releasably coupled to the base portion, wherein the base portion and/or the cover portion of the housing accommodate a hair collection chamber, wherein the external cutting member and the internal cutting member are held in an operating position in the cover portion by a holding component which is releasably coupled to the cover portion, wherein the housing has a closed position where the cover portion holding the external cutting member and the internal cutting member via the holding component is coupled to the base portion and closes the hair collection chamber, and an opened position where the cover portion is at least partially released and at least partially removed from the base portion so that the hair collection chamber is accessible for a user, wherein the base portion of the housing of each cutting unit comprises a supporting structure, and wherein, in the closed position of the housing, the external cutting member is directly supported by the supporting structure at least in an axial direction parallel to the axis of rotation.

17. The shaving apparatus according to claim 16, wherein the shaving unit shaver is releasably coupled to the main housing by a coupling member.

* * * * *